US010104470B2

(12) United States Patent
Kon

(10) Patent No.: US 10,104,470 B2
(45) Date of Patent: Oct. 16, 2018

(54) AUDIO PROCESSING DEVICE, AUDIO PROCESSING METHOD, RECORDING MEDIUM, AND PROGRAM

(75) Inventor: Homare Kon, Tokyo (JP)

(73) Assignee: SONY CORPORATION, Tokyo (JP)

( * ) Notice: Subject to any disclaimer, the term of this patent is extended or adjusted under 35 U.S.C. 154(b) by 310 days.

(21) Appl. No.: 13/591,727

(22) Filed: Aug. 22, 2012

(65) Prior Publication Data

US 2013/0089215 A1 Apr. 11, 2013

(30) Foreign Application Priority Data

Oct. 7, 2011 (JP) ..... 2011-223415

(51) Int. Cl.
*H04R 3/04* (2006.01)
*H04R 3/14* (2006.01)
*H04S 1/00* (2006.01)

(52) U.S. Cl.
CPC ..... *H04R 3/04* (2013.01); *H04R 3/14* (2013.01); *H04S 1/005* (2013.01)

(58) Field of Classification Search
CPC ..... H04R 3/04; H04R 2430/03; H04R 3/12; H04R 5/033; H04R 3/14; H04R 1/005; H04R 7/301; H03G 5/165; H03G 5/025; H04S 7/307; H04S 7/301
USPC ..... 381/74, 309, 310, 77, 79, 97, 98, 101, 381/102, 103, 58, 59, 95, 96
See application file for complete search history.

(56) References Cited

U.S. PATENT DOCUMENTS 5,438,623 A * 8/1995 Begault ..... 381/17
6,674,864 B1 * 1/2004 Kitamura ..... 381/103
6,760,451 B1 * 7/2004 Craven ..... H03G 5/005 381/59
8,085,950 B2 * 12/2011 Suzuki ..... H04R 3/04 181/160
8,116,480 B2 * 2/2012 Kubo ..... H04R 3/04 381/94.2
8,358,790 B2 * 1/2013 Teramoto ..... H04R 3/14 381/120
8,442,237 B2 * 5/2013 Kim et al. ..... 381/1
2005/0169488 A1 * 8/2005 Kato ..... H04S 7/302 381/98
2007/0025559 A1 * 2/2007 Mihelich et al. ..... H04S 7/301 381/59
2007/0127738 A1 * 6/2007 Yamada et al. ..... 381/98
(Continued)

FOREIGN PATENT DOCUMENTS

JP 2005-184040 7/2005

*Primary Examiner* — Jason R Kurr
(74) *Attorney, Agent, or Firm* — Paratus Law Group, PLLC

(57) ABSTRACT

An audio processing device includes a plurality of loudspeakers outputting audio for each band, a correction filter correcting an audio signal including a plurality of bands in accordance with characteristics of the plurality of loudspeakers, and a plurality of band division filters dividing the audio signal corrected by the correction filter into bands of the loudspeakers so that a phase difference of phase characteristics is approximately 0 degree or approximately 180 degrees. The correction filter is an inverse filter set with an impulse response based on the audio outputted for each band from the plurality of loudspeakers via the plurality of band division filters.

16 Claims, 20 Drawing Sheets

(56) References Cited

U.S. PATENT DOCUMENTS

2007/0253564 A1* 11/2007 Katayama ..... H04S 3/008
381/63
2007/0253575 A1* 11/2007 Melanson ..... H04R 3/12
381/97
2007/0276656 A1* 11/2007 Solbach et al. ..... 704/200.1
2012/0288124 A1* 11/2012 Fejzo ..... H04R 5/02
381/303

* cited by examiner

AUDIO PROCESSING DEVICE, AUDIO PROCESSING METHOD, RECORDING MEDIUM, AND PROGRAM

BACKGROUND

The present technology relates to an audio processing device, audio processing method, recording medium, and program and, in particular, to an audio processing device, audio processing method, recording medium, and program allowing audio output with high audio quality.

In designing an acoustic device such as a multi-way loudspeaker outputting audio for each of a plurality of bands, a technology of previously measuring acoustic characteristics of the entire acoustic device to enhance audio quality of outputted audio by an inverse filter or equalizing has been widely spread.

In related art, audio quality deteriorates when the band is widened for reproduction while frequency-amplitude characteristics and frequency-phase characteristics of plurality of loudspeakers are being disturbed. It is thus considered that audio quality can be enhanced by correcting the frequency-amplitude characteristics and the frequency-phase characteristics for each loudspeaker. However, to enhance audio quality by using limited calculation resources to configure a DSP (a digital signal processor), the limitation of the calculation resources in correcting an audio output of each loudspeaker restricts enhancement of audio quality.

Thus, a technology has been suggested in which correction is made by a correction filter over the entire band of an audio signal before band division and then the band is divided for output (refer to Japanese Unexamined Patent Application Publication No. 2005-184040).

SUMMARY

However, when the audio signal including all bands before band division is subjected to correction, an uncomfortable feeling in audio quality may occur in related art for a band near a crossover of each band obtained from divisions by band division, filters. To address such an uncomfortable feeling, the frequency-amplitude characteristics are improved for the band near the crossover. For this reason, while a technology has been suggested in which a filter increasing gain for the band near the crossover is configured, a sufficient effect has not yet been attained.

In the first place, when a 2-way or 3-way loudspeaker system for wideband reproduction or a 2.1-channel or 5.1-channel reproduction system is designed, a band division filter is configured based on the reproduction capability of each loudspeaker unit, propagation delay of each loudspeaker unit is corrected and, furthermore, a level balance among high, intermediate, low, and other frequencies is corrected.

However, a correction thereafter with signal processing by an inverse filter in consideration of the characteristics of the loudspeaker units is not considered.

For this reason, even when a loudspeaker system using a plurality of loudspeaker units is configured and favorable characteristics can be obtained to some extent, if a band near a crossover is adjusted by signal processing, an uncomfortable feeling may occur.

It is particularly desirable to enhance audio quality of an audio output not by correcting frequency-amplitude characteristics but by adjusting frequency-phase characteristics of band division filters.

An audio processing device according to an embodiment of the present technology includes a plurality of loudspeakers outputting audio for each band, a correction filter correcting an audio signal including a plurality of bands in accordance with characteristics of the plurality of loudspeakers, and a plurality of band division filters dividing the audio signal corrected by the correction filter into bands of the loudspeakers so that a phase difference of phase characteristics is approximately 0 degree or approximately 180 degrees, and the correction filter is an inverse filter set with an impulse response based on the audio outputted for each band from the plurality of loudspeakers via the plurality of band division filters.

The plurality of band division filters can divide the audio signal corrected by the correction filter only for a predetermined frequency band into the bands of the loudspeakers so that the phase difference of the phase characteristics is approximately 0 degree or approximately 180 degrees.

An amplifying unit amplifying the audio signal can further be included, and the amplifying unit can be formed of one amplifying unit amplifying the audio signal before division by the band division filters or a plurality of amplifying units amplifying the audio signal for each band obtained from division by the band division filters.

An additional filter adding an acoustic characteristic of another audio processing device to the audio signal can further be included, and the acoustic characteristic of the other audio processing device can be downloaded from a library connected via a network.

The additional filter can be formed of one additional filter adding the audio characteristic of the other audio processing device to the audio signal before division by the band division filters or a plurality of additional filters adding the audio characteristic of the other audio processing device for each band obtained from division by the band division filters.

An earphone including any one of the audio processing devices described above can be provided, and the audio signal to be inputted can be a multichannel audio signal synthesized with an audio signal subjected to auditory lateralization with a head-related transfer function.

An audio processing method according to another embodiment of the present technology for an audio processing device including a plurality of loudspeakers outputting audio for each band includes performing a process, with a correction filter, of correcting an audio signal including a plurality of bands in accordance with characteristics of the loudspeakers, and performing a process, with a plurality of band division filters, of dividing the audio signal corrected by the correction filter into bands of the loudspeakers so that a phase difference of phase characteristics is approximately 0 degree or approximately 180 degrees, and the correction filter is an inverse filter set with an impulse response based on the audio outputted for each band from the plurality of loudspeakers via the plurality of band division filters.

A program according to still another embodiment of the present technology causes a computer controlling an audio processing device including a plurality of loudspeakers for outputting audio for each band to function as a correction filter correcting an audio signal including a plurality of bands in accordance with characteristics of the plurality of loudspeakers, and a plurality of band division filters dividing the audio signal corrected by the correction filter into bands of the loudspeakers so that a phase difference of phase characteristics is approximately 0 degree or approximately 180 degrees, and the correction filter is an inverse filter set with an impulse response based on the audio outputted for each band from the plurality of loudspeakers via the plurality of band division filters.

A recording medium according to yet another embodiment of the present technology has the program according to the still other embodiment recorded thereon.

In the embodiments of the present technology, audio is outputted from the plurality of loudspeakers for each band, the audio signal including a plurality of bands is corrected in accordance with the characteristics of the plurality of loudspeakers, the corrected audio signal is divided into the bands of the loudspeakers so that the phase difference of the phase characteristics is approximately 0 degree or approximately 180 degrees, and the audio signal including the plurality of bands is divided into the plurality of bands and is corrected by an inverse filter set with an impulse response based on the audio outputted for each band from the plurality of loudspeakers.

The audio processing device according to the embodiments of the present technology may be a standalone device or may be a block performing an audio process.

According to the embodiments of the present technology, audio quality of audio output can be enhanced.

DETAILED DESCRIPTION OF EMBODIMENTS

Embodiments of the present technology (hereinafter refer to as embodiments) are described. Note that description is made in the following order.

1. Embodiment
2. First Modification Example
3. Second Modification Example
4. Third Modification Example
5. Fourth Modification Example 1. Embodiment

[Example of Structure of an Output Unit to which an Audio Processing Device of Related Art is Applied]

Figure 1:
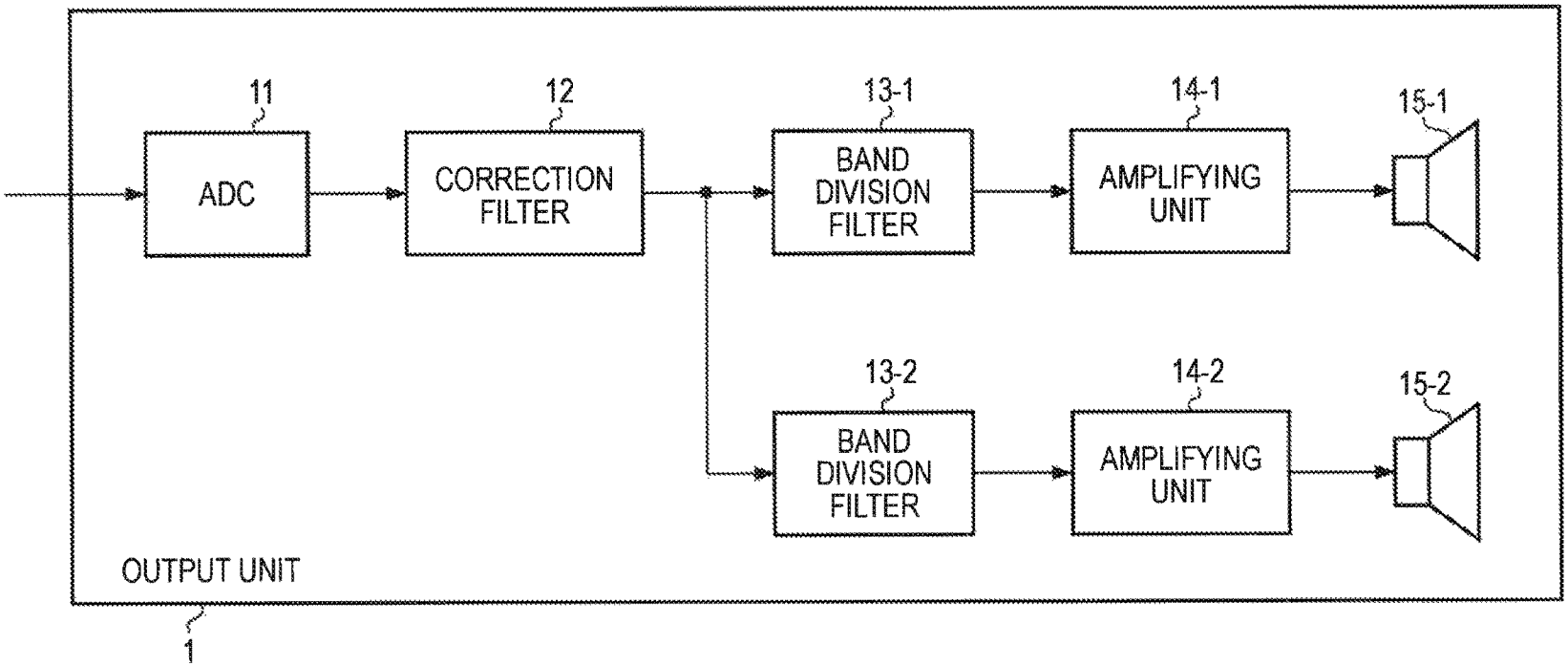
FIG. 1 is a diagram of an example of structure of an output unit to which an audio processing device of related art is applied.

Prior to description of the output unit to which the audio processing device of an embodiment of the present technology is applied, the structure of an output unit to which an audio processing device of related art is applied is described. FIG. 1 is a diagram for describing an example of the structure of the output unit to which the audio processing device of related art is applied. The output unit of FIG. 1 outputs audio with audio quality enhanced based on an inputted audio signal.

An output unit 1 outputs audio with audio quality enhanced based on an inputted audio signal formed of an analog signal. The output unit 1 is configured to include an ADC (analog digital converter) 11, a correction filter 12, band division filters 13-1 and 13-2, amplifying units 14-1 and 14-2, and loudspeakers 15-1 and 15-2.

The ADC 11 converts an audio signal formed of an analog signal to a digital audio signal and supplies the digital audio signal to the correction filter 12. The correction filter 12 is an inverse filter found based on an impulse response that is measured by picking up, with the use of a microphone, audio signals outputted from the loudspeakers 15-1 and 15-2 if an impulse is inputted without this filter, that is, without correction. With this, audio outputted from the loudspeakers 15-1 and 15-2 is corrected.

The band division filters 13-1 and 13-2 are digital filters formed of, for example, IIR (infinite impulse response) filters, dividing an audio signal corrected by the correction filter 12 for each band and outputting the resultant signal to the amplifying units 14-1 and 14-2. In the band division filters 13-1 and 13-2 of FIG. 1, the hand division filter 13-1 extracts an audio signal of a high frequency band, and the band division filter 13-2 extracts an audio signal of a low frequency band. The amplifying units 14-1 and 14-2 each amplify the audio signal of each predetermined band and cause the amplified audio signals to be outputted from the loudspeakers 15-1 and 15-2 as audio. The loudspeakers 15-1 and 15-2 have different frequency bands of audio to be outputted. In the example of FIG. 1, the loudspeaker 15-1 outputs an audio signal of the high frequency band, and the loudspeaker 15-2 outputs an audio signal of the low frequency band. Note that while the example is depicted in FIG. 1 where the amplifying units 14-1 and 14-2 perform a digital signal amplifying process of amplifying a digital audio signal and convert the digital signal to an analog signal for output to the loudspeakers 15-1 and 15-2, an analog signal amplifying process may be performed after the digital audio signal is converted to an analog signal.

Figure 2:
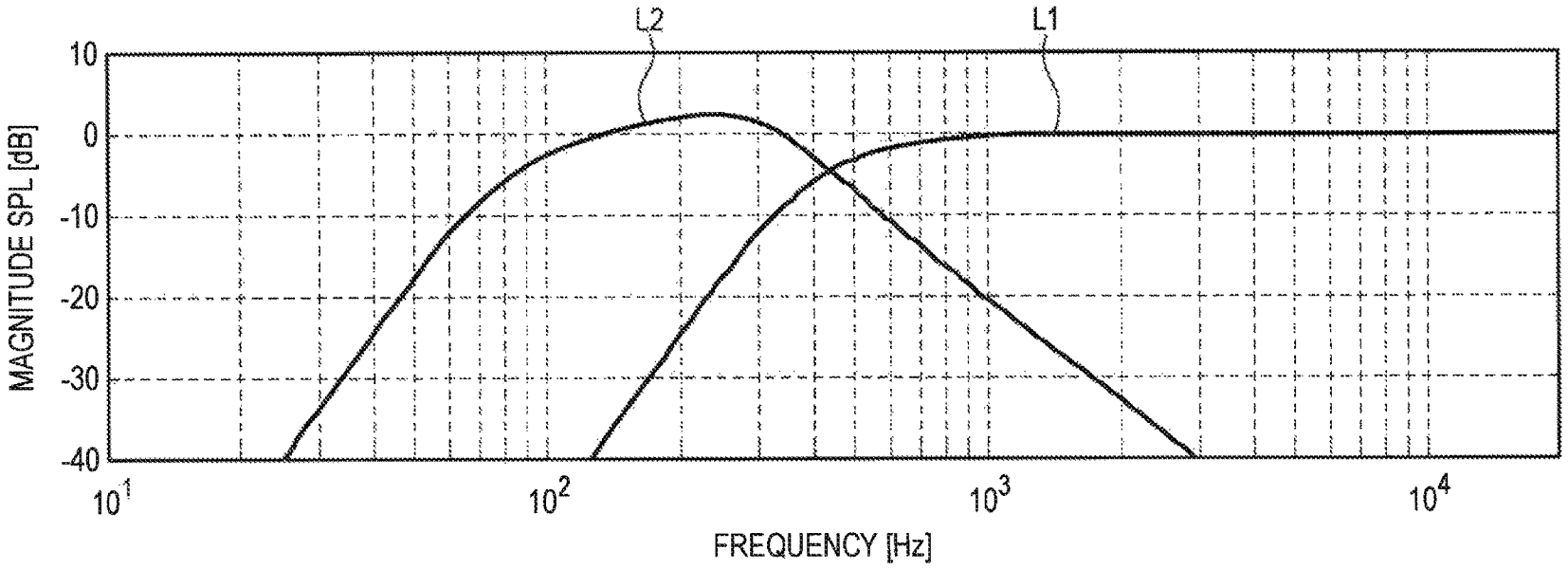
FIG. 2 is a diagram for describing frequency-amplitude characteristics for each band by band division filters of the output unit of FIG. 1.

Frequency-amplitude characteristics of the band division filters 13-1 and 13-2 are represented by, for example, waveforms L1 and L2, respectively, in FIG. 2, for example. That is, the waveform L1 rises at −40 dB with a frequency near 100 Hz, and becomes constant at 0 dB with a frequency near 1000 Hz. Also, the waveform L2 is a convex waveform having a peak with a frequency near 200 Hz. Furthermore, a crossover band between the waveforms L1 and L2 has frequencies near 400 Hz to 500 Hz. Note in FIG. 2 that the horizontal axis represents frequency bands and the vertical axis represents amplitudes.

Figure 3:
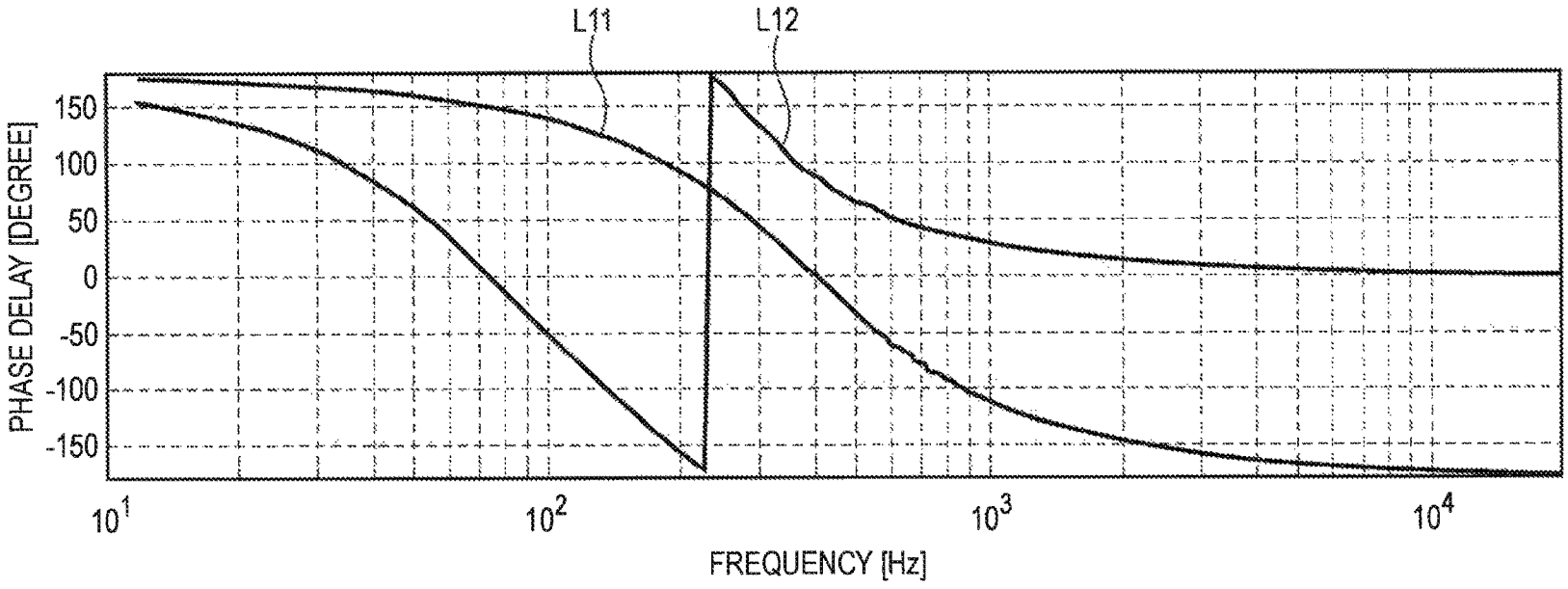
FIG. 3 is a diagram for describing frequency-phase characteristics for each band by the band division filters of the output unit of FIG. 1.

Frequency-phase characteristics of the band division filters 13-1 and 13-2 are depicted in FIG. 3. That is, a waveform L11 has a phase of 160 degrees with a frequency near 10 Hz, and the phase starts gradually delaying as the frequency increases and delays to −160 degrees with a frequency near 200 Hz. Then, phase inversion occurs and the phase advances by 160 degrees. Thereafter, the phase changes so as to be closer to 0 degree. On the other hand, a waveform L12 has a phase of 160 degrees with a frequency of 10 Hz, and the phase starts gradually delaying as the frequency advances and delays to 0 degree with a frequency near 400 Hz. Thereafter, the phase changes so as to be closer to 180 degrees. Note in FIG. 3 that the horizontal axis represents frequency bands and the vertical axis represents phase angles.

Figure 4:
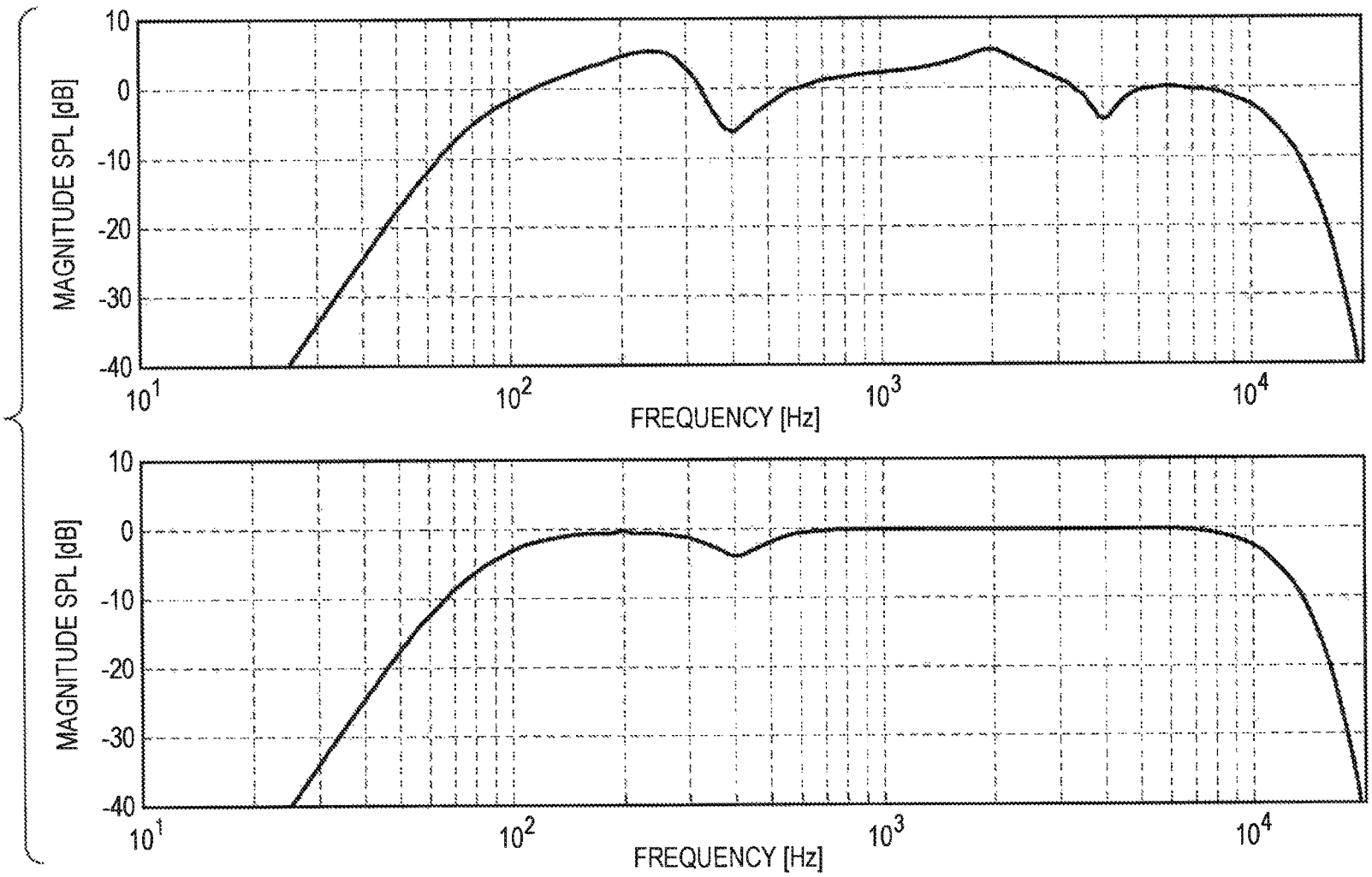
FIG. 4 is a diagram for describing frequency-amplitude characteristics before and after correction of the output unit of FIG. 1.
Figure 9:
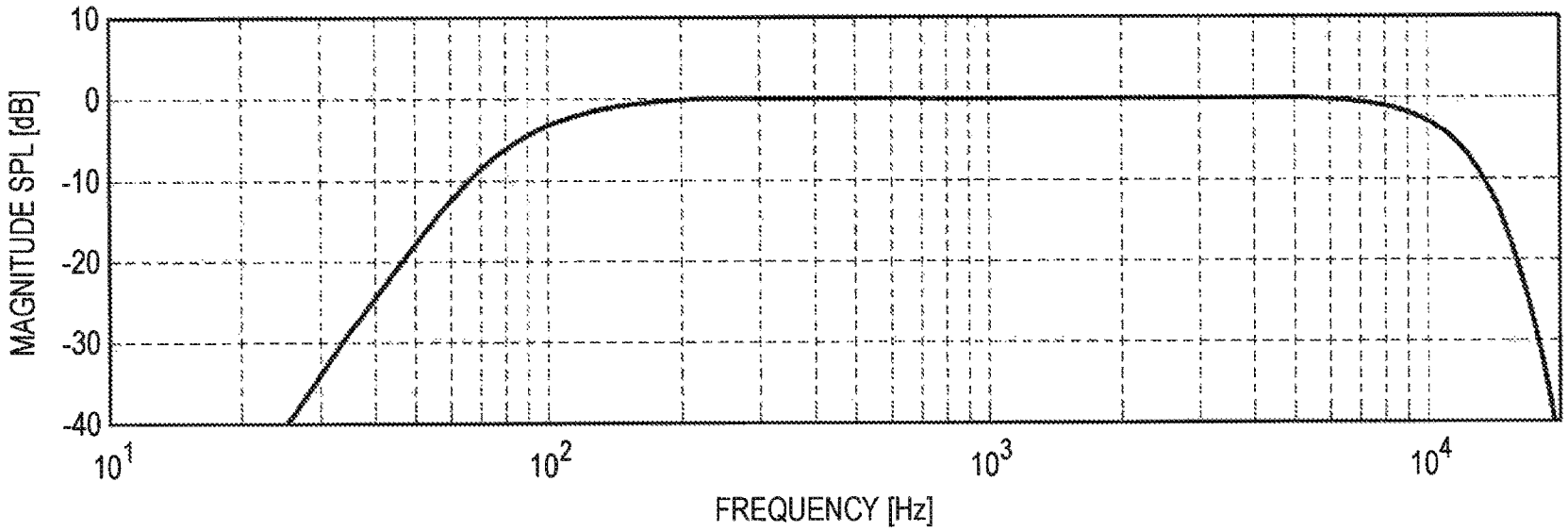
FIG. 9 is a diagram for describing ideal frequency-amplitude characteristics of the output unit of FIG. 5.

The amplitude characteristics of the output unit 1 without this correction filter 12 are represented by a convexo-concave amplitude waveform with respect to the frequency band depicted in an upper part of FIG. 4. By contrast, with the correction filter 12, as depicted in a lower part of FIG. 4, the amplitude in each frequency band is flattened. However, a concave part is present near 400 Hz, which is near a crossover, and flat amplitude characteristics are not present only at this portion. In related art, a filter process or an equalizing process is performed to address this concave part. Note that the concave part in the lower part of FIG. 4 occurs in a 2-way or 3-way loudspeaker system and the amplitude has an ideal flat waveform in each band in a system with one loudspeaker as depicted in FIG. 9, which will be described further below. Note in FIG. 4 and FIG. 9 that the horizontal axis represents frequency bands and the vertical axis represents amplitude in the respective frequency bands.

[Example of Structure of an Output Device to which the Audio Processing Device According to the Embodiment of the Present Technology is Applied]

Figure 5:
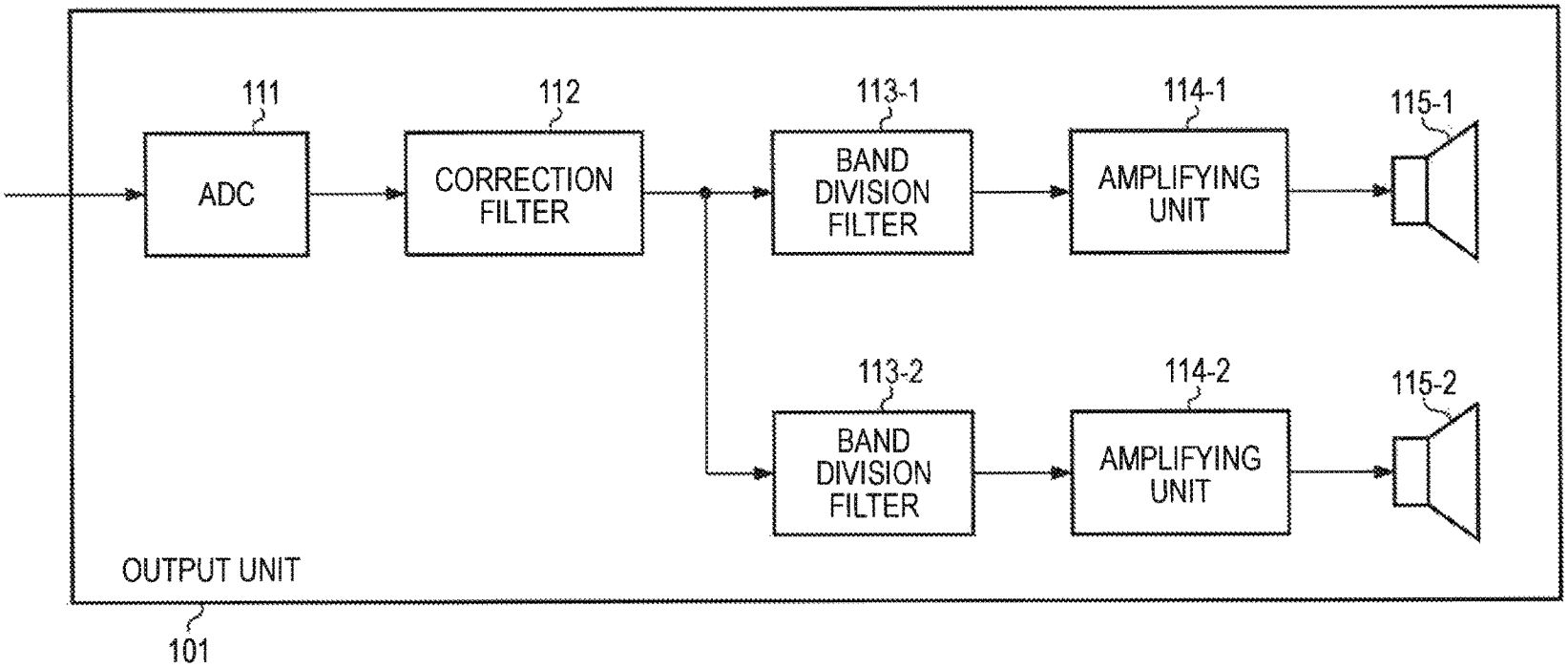
FIG. 5 is a diagram of an example of structure of an output unit to which an audio processing device according to an embodiment of the present technology is applied.

Next, with reference to FIG. 5, description is made to an example of structure of an output unit to which the audio processing device according to the embodiment of the present technology is applied. The output unit of FIG. 5 outputs audio with audio quality enhanced based on an inputted audio signal so as to make amplitudes of the entire band ideal.

An output unit 101 outputs audio with audio quality enhanced based on an inputted audio signal formed of an analog signal. The output unit 101 is configured to include an ADC (analog digital converter) 111, a correction filter 112, band division filters 113-1 and 113-2, amplifying units 114-1 and 114-2, and loudspeakers 115-1 and 115-2.

The ADC 111 is basically similar to the ADC 11, converting an audio signal formed of an analog signal to a digital audio signal and supplying the digital audio signal to the correction filter 112. The correction filter 112 is basically similar to the correction filter 12, being an inverse filter found based on an impulse response that is measured by picking up, with the use of a microphone, audio signals outputted via the band division filter 113-1 and 113-2, the amplifying units 114-1 and 114-2, and the loudspeakers 115-1 and 115-2, which will be described further below, if an impulse is inputted without this filter, that is, without correction. With this, audio outputted from the loudspeakers 115-1 and 115-2 is corrected.

Figure 6:
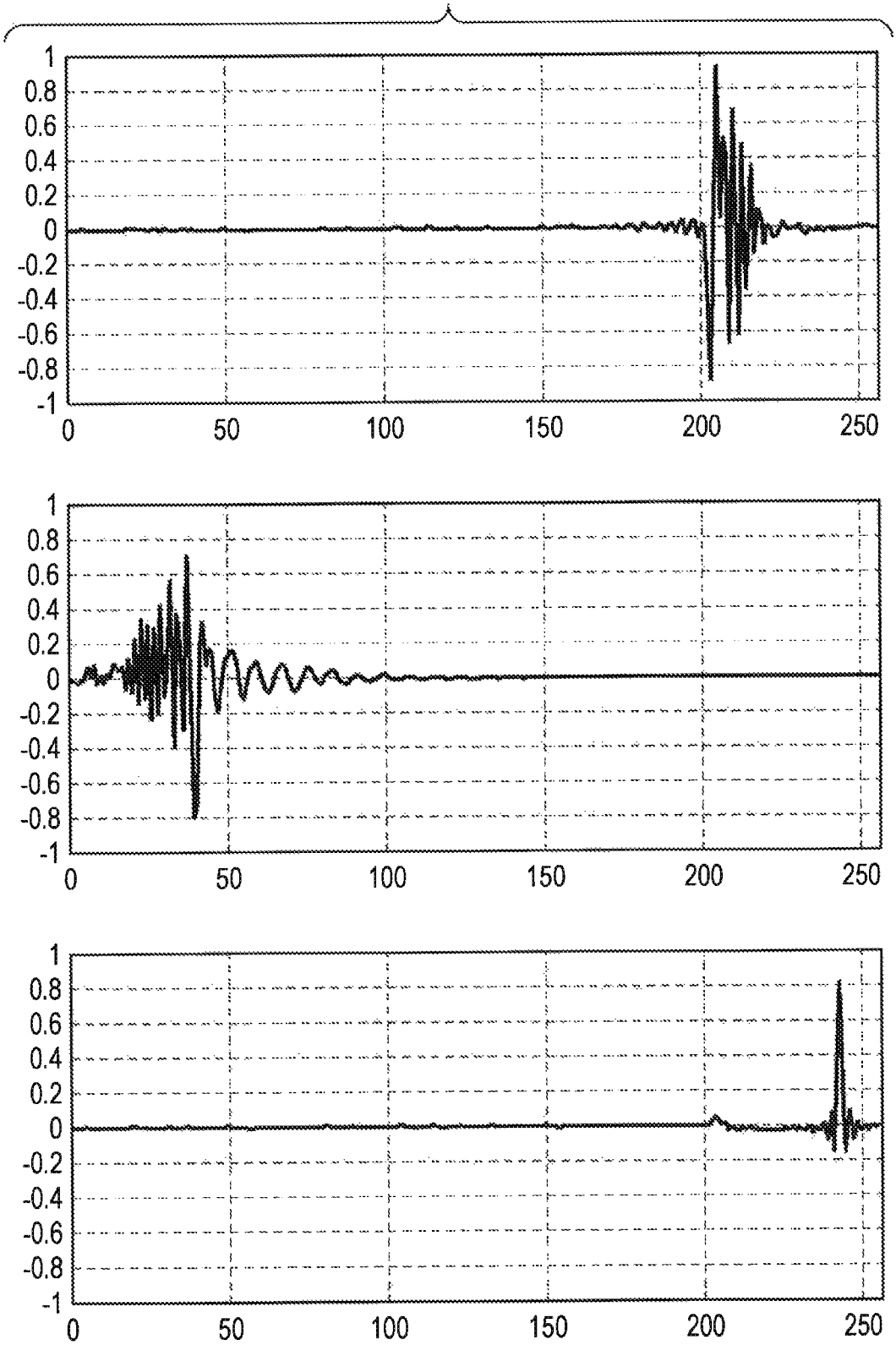
FIG. 6 is a diagram for describing an impulse response of the output unit of FIG. 5 and a correction filter formed of an inverse filter.

In more detail, the correction filter 112 is an inverse filter set in accordance with a waveform, that is, an impulse response, that is obtained, by picking up, with the use of a microphone, audio outputted via the band division filter 113-1 and 113-2, the amplifying units 114-1 and 114-2, and the loudspeakers 115-1 and 115-2, if, for example, an impulse signal is inputted to, for example, the output unit 101, without the correction filter 112 (without correction). For example, if the impulse response is such as the one depicted in an upper part of FIG. 6, the inverse filter of the loudspeaker system configured to include the loudspeakers 115-1 and 115-2 is as depicted in an intermediate part of FIG. 6. That is, the correction filter 112 is the inverse filter as depicted in the intermediate part of FIG. 6. When an impulse signal is inputted with this correction filter 112 being provided, an impulse response has a shaped waveform as shown in a lower part of FIG. 6. Note in every part of FIG. 6 that the horizontal axis represents elapsed time (ms) and the vertical axis represents normalized amplitudes.

The band division filters 113-1 and 113-2 are, for example, digital filters formed of, for example, (infinite impulse response) filters, and a phase difference of the frequency-phase characteristics for each band is approximately 0 degree (or 180 degrees). The band division filters 113-1 and 113-2 each divide an audio signal corrected by the correction filter 112 for each band and output the resultant signal to the amplifying units 114-1 and 114-2. Note that in the band division filters 113-1 and 113-2 of FIG. 5, the band division filter 113-1 extracts an audio signal of a high frequency band, and the band division filter 113-2 extracts an audio signal of a low frequency band.

The amplifying units 114-1 and 114-2 are basically similar to the amplifying units 14-1 and 14-2, each amplifying the audio signal of each predetermined band and causing the amplified audio signals to be outputted from the loudspeakers 115-1 and 115-2 as audio. The loudspeakers 115-1 and 115-2 are basically similar to the loudspeakers 15-1 and 15-2, having different frequency bands of audio to be outputted. In the example of FIG. 5, the loudspeaker 115-1 outputs an audio signal of the high frequency band, and the loudspeaker 115-2 outputs an audio signal of the low frequency band. Note that while the example is depicted also in FIG. 5 where the amplifying units 114-1 and 114-2 perform a digital signal amplifying process of amplifying a digital audio signal and convert the digital signal to an analog signal for output to the loudspeakers 115-1 and 115-2, an analog signal amplifying process may be performed after the digital audio signal is converted to an analog signal.

Figure 7:
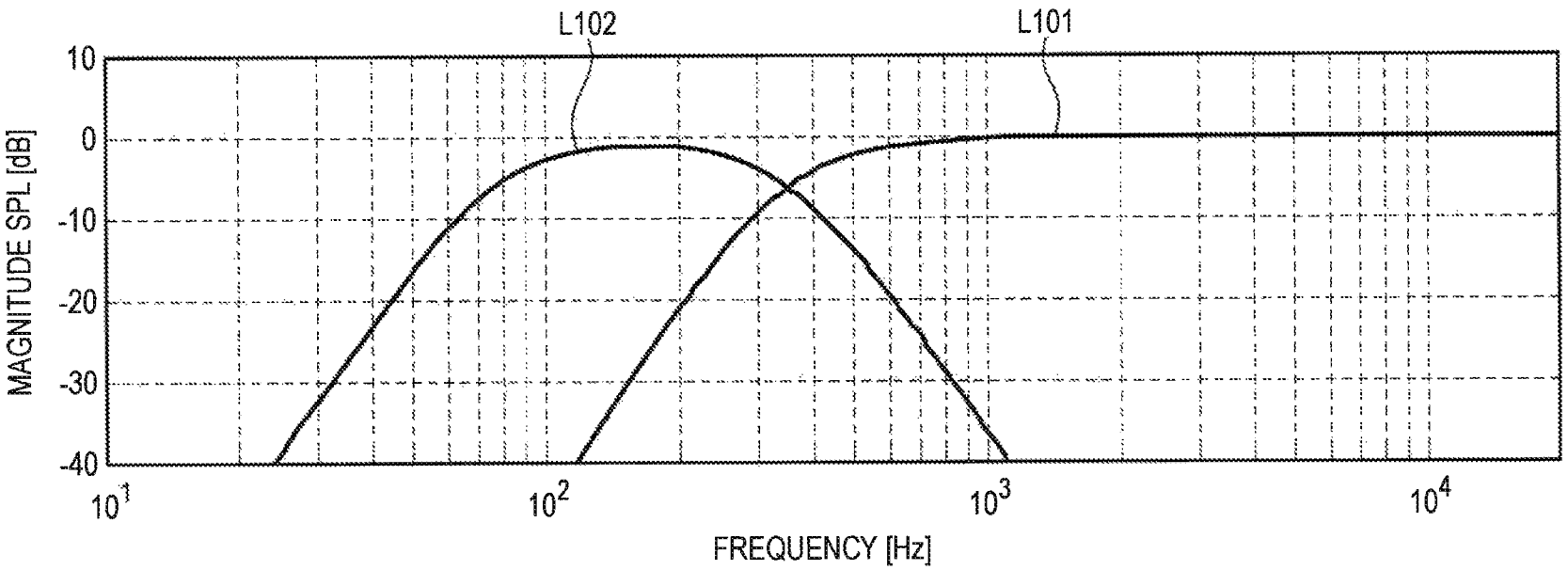
FIG. 7 is a diagram for describing frequency-amplitude characteristics for each band by band division filters of the output unit of FIG. 5.

Frequency-amplitude characteristics of the band division filters 113-1 and 113-2 are represented by, for example, waveforms L101 and L102, respectively, in FIG. 7, which are approximately similar to those of the band division filters 13-1 and 13-2 described with reference to FIG. 2. That is, the waveform L101 rises at −40 dB with a frequency near 100 Hz, and becomes constant at 0 dB with a frequency near 1000 Hz. Also, the waveform L102 is a convex waveform having a peak with a frequency near 200 Hz. Furthermore, a crossover band between the waveforms L101 and L102 has frequencies near 300 Hz to 400 Hz. Note in FIG. 7 that the horizontal axis represents frequency bands and the vertical axis represents amplitudes.

Figure 8:
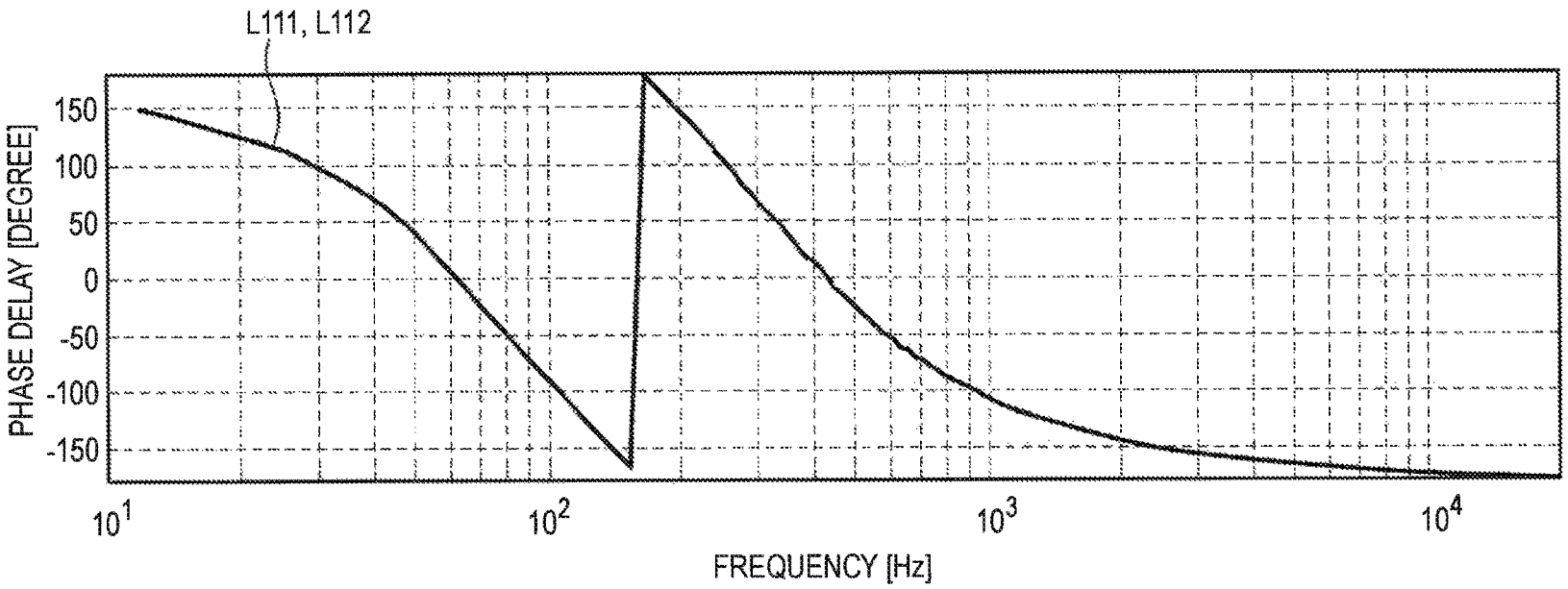
FIG. 8 is a diagram for describing frequency-phase characteristics for each band by the band division filters of the output unit of FIG. 5.

Frequency-phase characteristics of the band division filters 113-1 and 113-2 are depicted in FIG. 8, which are different from those of the band division filters 13-1 and 13-2 described with reference to FIG. 3. That is, phase waveforms represented by waveforms L111 and L112 exactly match, that is, a phase difference therebetween is 0. The phase is 150 degrees with a frequency near 10 Hz. When the frequency increases, the phase gradually starts delaying, and after the phase delays to −160 degrees with a frequency near 200 Hz, the phase is reversed to advance by 160 degrees. Thereafter, the phase changes so as to be closer to −180 degrees. Note in FIG. 8 that the horizontal axis represents frequency bands and the vertical axis represents phase angles.

As a result, the amplitude for each frequency band of the audio signal outputted from each of the loudspeakers 115-1 and 115-2 has a waveform rising at −40 dB from a frequency near 20 Hz and converging to 0 dB with a frequency near 200 Hz.

[Output Process by the Output Unit of FIG. 5]

Figure 10:
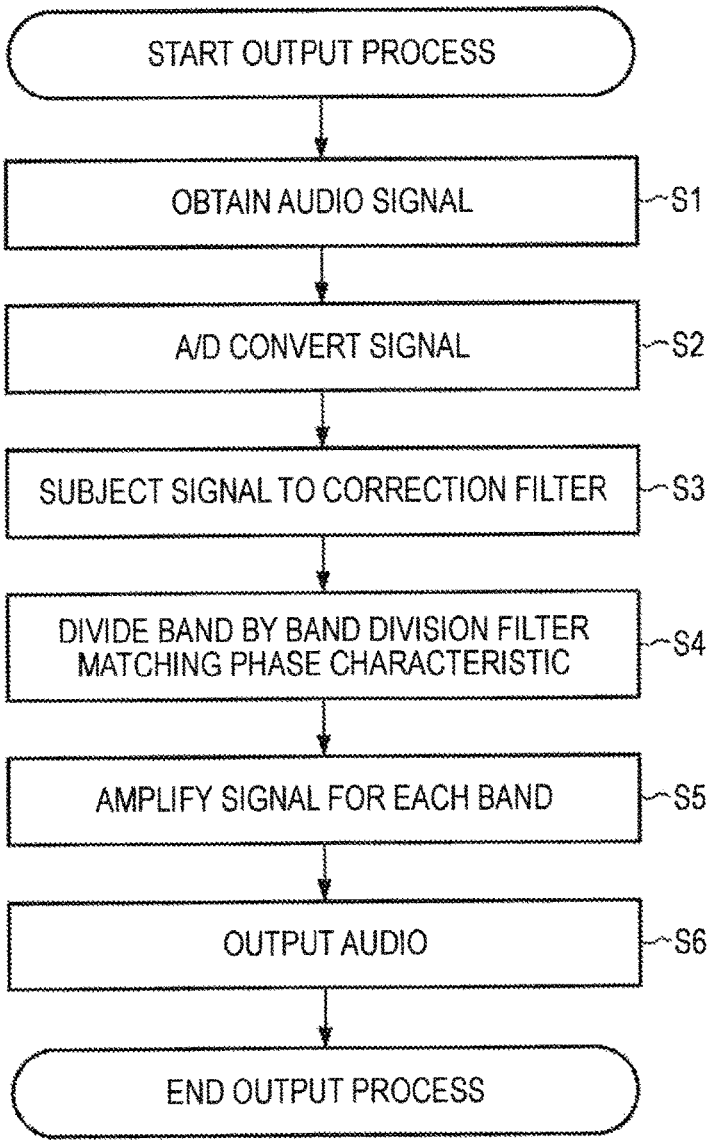
FIG. 10 is a flowchart for describing an output process by the output unit of FIG. 5.

Next, an output process by the output unit 101 of FIG. 5 is described with reference to flowchart of FIG. 10.

At step S1, the ADC 111 obtains an inputted analog audio signal.

At step S2, the ADC 111 performs an analog-to-digital conversion on the obtained analog audio signal to a digital audio signal, and supplies the digital audio signal to the correction filter 112.

At step S3, the correction filter 112 performs a correction filter process on the supplied digital audio signal, and supplies the resultant signal to the band division filters 113-1 and 113-2.

At step S4, the band division filters 113-1 and 113-2 extract an audio signal of a high frequency band and an audio signal of a low frequency band, and supply the extracted signal to the amplifying units 114-1 and 114-2, respectively. Here, the band division filters 113-1 and 113-2 extract audio signals for the respective frequency bands so that the phases of the audio signals obtained by division match each other, in accordance with the frequency-phase characteristics of FIG. 8, for example.

At step S5, the amplifying units 114-1 and 114-2 amplify the audio signal of the high frequency band and the audio signal of the low frequency band supplied from the band division filters 113-1 and 113-2, respectively, convert the amplified signals to analog signals, and then output the analog signals to the loudspeakers 115-1 and 115-2, respectively.

At step S6, the loudspeakers 115-1 and 115-2 output audio of the high frequency band and audio of the low frequency band, respectively.

That is, in the band division filters 113-1 and 113-2, the phase difference of the audio signals extracted for each band is approximately 0 degree, as depicted in the frequency-phase characteristics of FIG. 8. Therefore, the correction filter 112 is an inverse filter found based on an impulse response that is measured by picking up, with the use of a microphone, audio signals outputted via the band division filters 113-1 and 113-2 having a phase difference of audio signals for each extracted band being approximately 0 degree each other from the amplifying units 114-1 and 114-2 and the loudspeakers 115-1 and 115-2. Therefore, the audio signal outputted from the loudspeaker 115-1 of the high frequency band and the audio signal outputted from the loudspeaker 115-2 of the low frequency band are simultaneously corrected by the correction filter 112 at a stage prior to band division, and therefore ideal frequency-amplitude characteristics can be obtained.

As a result, the frequency-amplitude characteristics and the frequency-phase characteristics as the overall output unit 101 including the loudspeakers 115-1 and 115-2 are improved. Therefore, wideband audio excellent in tone balance and having enhanced audio quality can be outputted.

Figure 11:
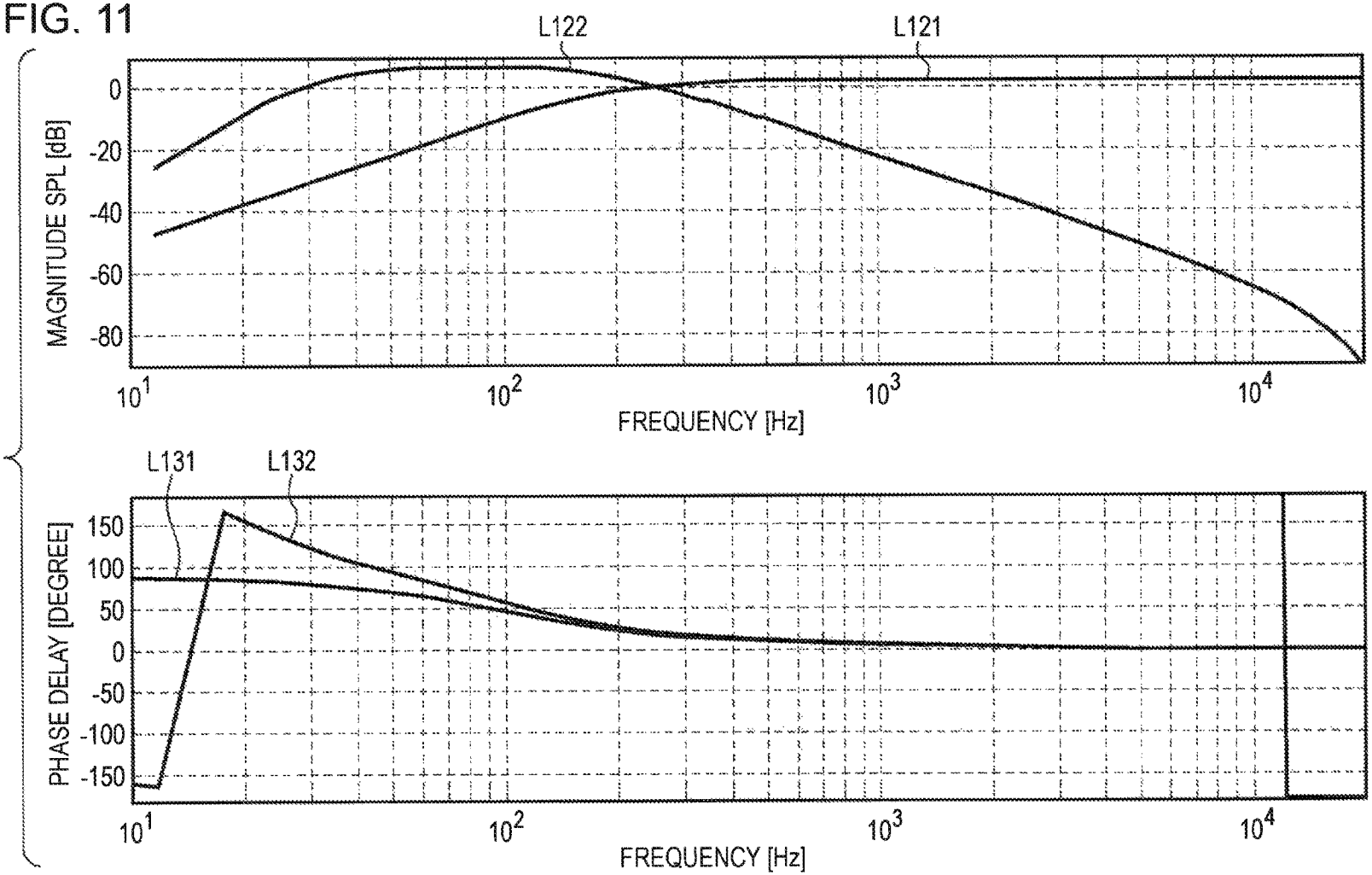
FIG. 11 is a diagram for describing another example of frequency-phase characteristics for each band by the band division filters of the output unit of FIG. 5.

Note that while description has been made above to the example as depicted in FIG. 8 where the phase difference of the audio signals of the entire frequency band of the band division filters 113-1 and 113-2 is approximately 0, it is sufficient that the phase difference of the audio signals of a desired part of the frequency bands is approximately 0. That is, when only a frequency band near 200 Hz is desired to be flattened, as depicted in an upper part of FIG. 11, the phase difference is set to be approximately 0 degree with a frequency near 200 Hz, as depicted with a waveform L121 representing the phase of a first frequency band and a waveform L122 representing the phase of a second frequency band after band division. Also, when only a frequency band equal to or higher than 100 Hz is desired to be flattened, as depicted in a lower part of FIG. 11, the phase difference is set to be approximately 0 degree with a frequency equal to or higher than 100 Hz, as depicted with a waveform L131 representing the phase of a first frequency band and a waveform L132 representing the phase of a second frequency band.

Also, it has been empirically found that as long as the phase difference of the frequency-phase characteristics in the band division filters is in a range from approximately 0 degree to approximately 90 degrees, the frequency-amplitude characteristics of the corresponding frequency band can be approximately flattened. Furthermore, it has also been found that even when the phase difference of the frequency-phase characteristics in the band division filters is set to be approximately 180 degrees, the frequency-phase characteristics of the corresponding frequency band may be approximately flattened. In this case, it has been found that as long as the phase difference of the frequency-phase characteristics in the band division filters is in a range from approximately 90 degrees to approximately 180 degrees, the frequency-amplitude characteristics of the corresponding frequency band can also be approximately flattened. Therefore, the frequency-amplitude characteristics may be approximately flattened by setting the phase difference of the frequency-phase characteristics in the band division filters at approximately 0 degree or approximately 180 degrees.

2. First Modification Example

[Example of Structure of an Output Unit where an Amplifying Unit is Provided to a Stage Previous to the Band Division Filters]

While the example has been described above in which the amplifying units 114-1 and 114-2 are provided to stages subsequent to the band division filters 113-1 and 113-2, respectively, an amplifying unit may be provided to a stage previous to the band division filters 113-1 and 113-2.

Figure 12:
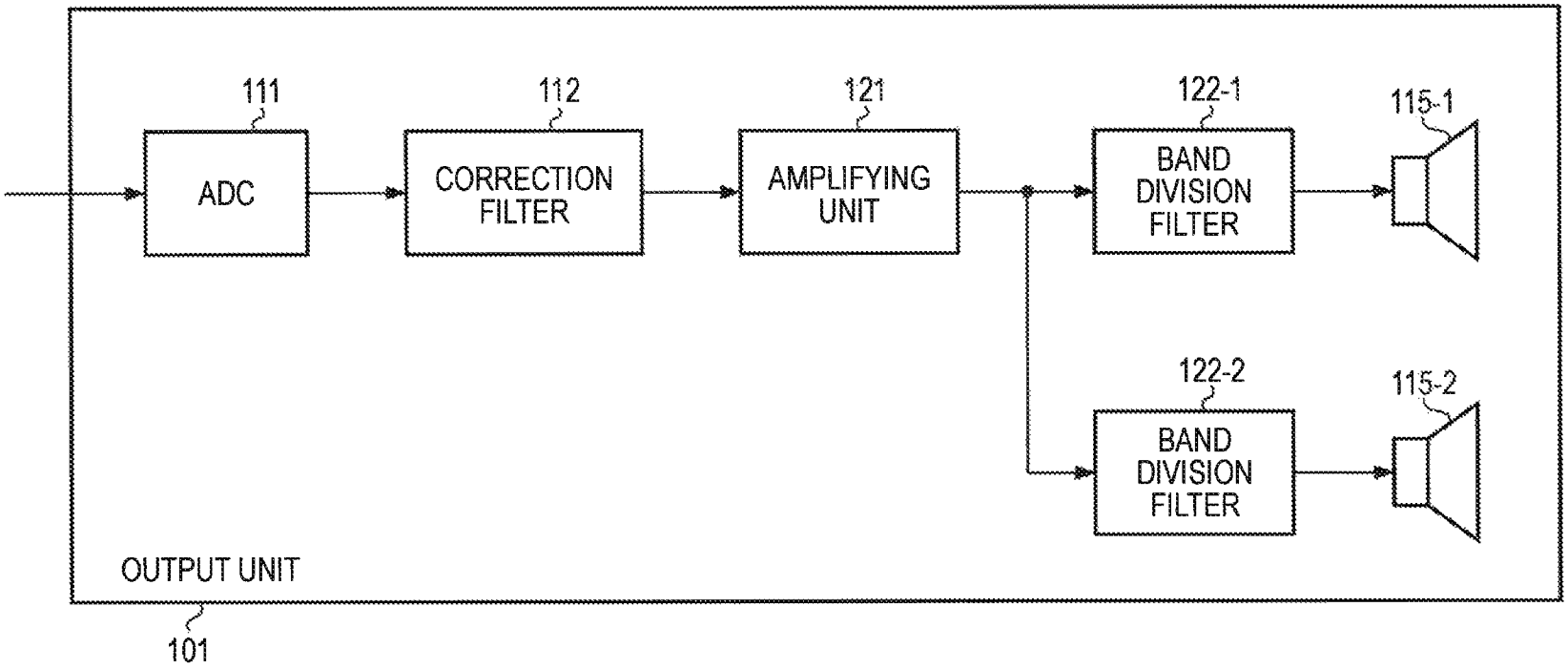
FIG. 12 is a diagram of an example of structure of an output unit to which the audio processing device according to a first modification example of the present technology is applied.

FIG. 12 depicts an example of structure of the output unit 101 in which an amplifying unit is provided to stages previous to the band division filters. Note in FIG. 12 that a structure including the same function as that of FIG. 5 is provided with the same name and the same reference numeral, and description of that structure is omitted as appropriate. That is, the output unit 101 of FIG. 12 is different from the output unit 101 of FIG. 5 in that, in place of the band division filters 113-1 and 113-2 and the amplifying units 114-1 and 114-2, an amplifying unit 121 and band division filters 122-1 and 122-2 are provided. Note that while the basic functions are the same and therefore are not described herein, since the amplifying unit 121 is provided to a stage previous to the hand division filters 122-1 and 122-2 in the output unit 101 of FIG. 12, for example, when the amplifying unit 121 is an analog amplifying unit including an analog-digital converting unit, the band division filters 122-1 and 122-2 are configured as analog filters.

[Output Process by the Output Unit of FIG. 12]

Figure 13:
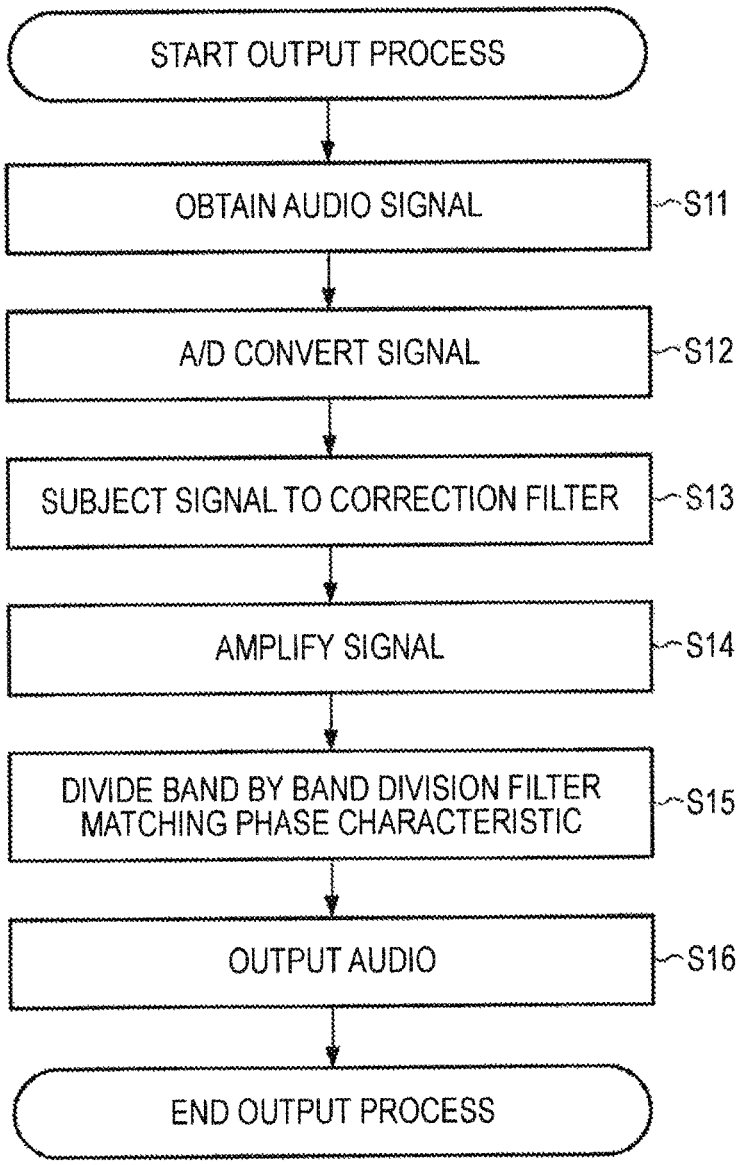
FIG. 13 is a flowchart for describing an output process by the output unit of FIG. 12.

Next, an output process by the output unit 101 of FIG. 12 is described with reference to a flowchart of FIG. 13. Note that processes at steps S11 to S13 and S16 in the flowchart of FIG. 13 are similar to the processes at steps S1 to S3 and S6 described with reference to the flowchart of FIG. 10, and therefore are not described herein. That is, at steps S11 to S13 in FIG. 13, an audio signal is obtained, is subjected to analog-digital conversion, and is subjected to a correction filter.

Then, at step S14, the amplifying unit 121 amplifies the audio signal including the entire band, and supplies the resultant signal to the band division filters 122-1 and 122-2.

At step S15, the band division filters 122-1 and 122-2 each divide the audio signal supplied from the amplifying unit 121 into each band for extraction, and supply the audio signals formed of the respective extracted band signals to the loudspeakers 115-1 and 115-2. With this, the loudspeakers 115-1 and 115-2 output audio at step S16.

With the processes described above, operations and effects similar to those of the output unit 101 of FIG. 1 can be made possible. As a result, audio quality of the audio output can be enhanced.

3. Second Modification Example

[Example of Structure of an Output Unit where an Audio Signal Divided for Each Band is Subjected to Loudspeaker Simulation Filters]

While the example has been described above in which reproduction of the original sound with a high degree of fidelity by flattening the frequency-amplitude characteristics enhances audio quality, the audio quality depends on preferences and, in actuality, for example, some dislikes flattened audio. In order to address this case, target frequency characteristics may be added to the correction filter 112. Also, a filter that subjects an audio signal divided for each band by band division filters to various loudspeaker characteristics may be provided.

Figure 14:
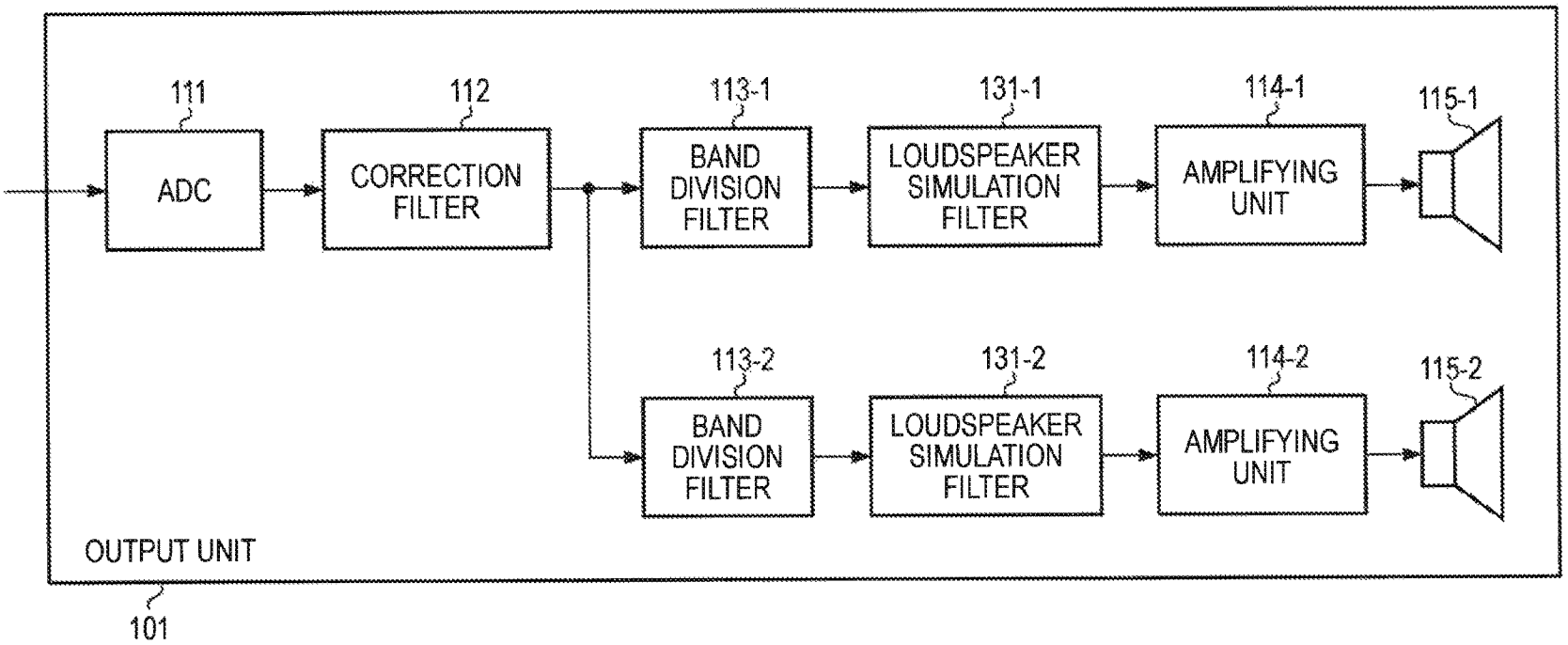
FIG. 14 is a diagram of an example of structure of an output unit to which the audio processing device according to a second modification example of the present technology is applied.

FIG. 14 depicts an example of structure of the output unit 101 where a filter that subjects an audio signal divided for each band by the band division filters to various loudspeaker characteristics is provided. Note in the output unit 101 of FIG. 14 that a structure including the same function as that of the output unit 101 of FIG. 5 is provided with the same name and the same reference numeral, and description of that structure is omitted as appropriate. That is, the output unit 101 of FIG. 14 is different from the output unit 101 of FIG. 5 in that loudspeaker simulation filters 131-1 and 131-2 are provided between the band division filters 113-1 and 113-2 and the amplifying units 114-1 and 114-2. The loudspeaker simulation filters 131-1 and 131-2 are filters that add various loudspeaker characteristics. With this process, the loudspeakers 115-1 and 115-2 can output audio with audio quality as if having acoustic characteristics of various loudspeakers.

[Output Process by the Output Unit of FIG. 14]

Figure 15:
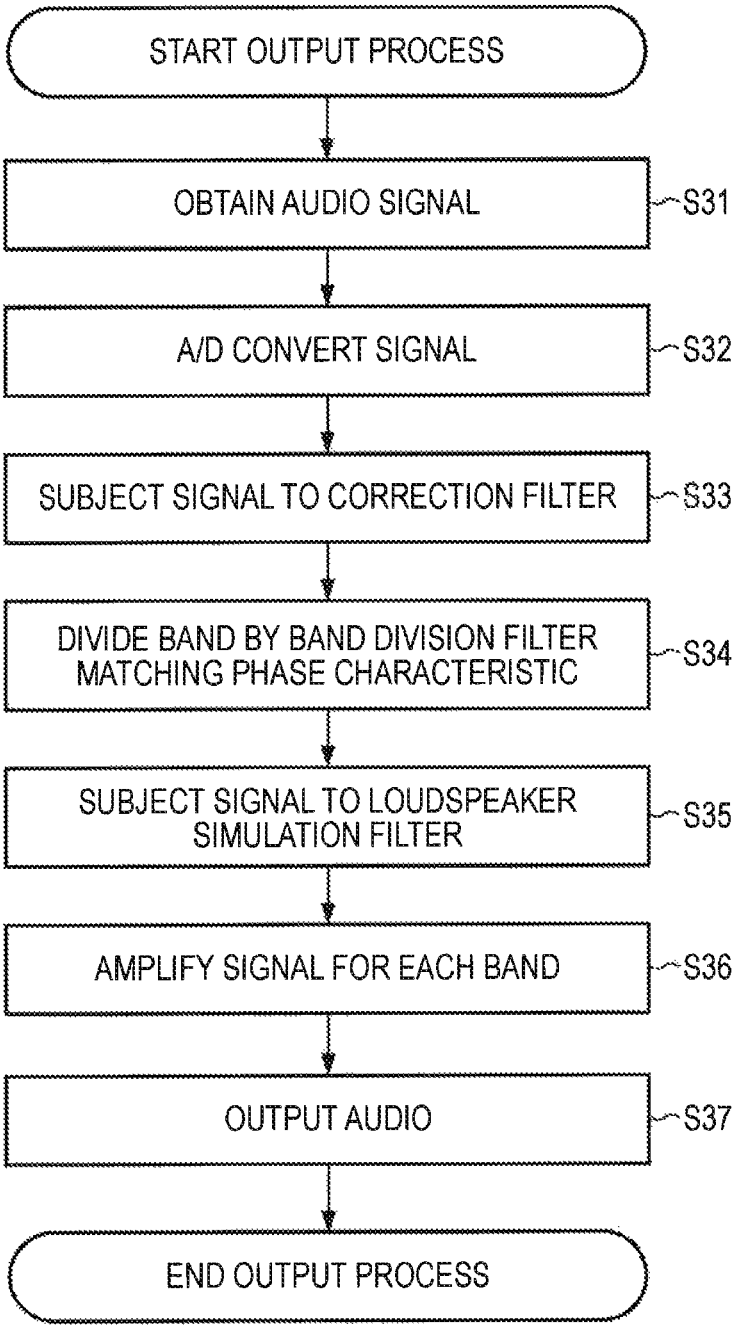
FIG. 15 is a flowchart for describing an output process by the output unit of FIG. 14.

Next, an output process by the output unit 101 of FIG. 14 is described with reference to a flowchart of FIG. 15. Note that processes at steps S31 to S34, S36, and S37 in the flowchart of FIG. 15 are similar to the processes at steps S1 to S6 described with reference to the flowchart of FIG. 10, and therefore are not described herein. That is, at steps S31 to S34 in FIG. 13, an audio signal is obtained, is subjected to analog-digital conversion and a correction filter, and is then divided for each band.

Then, at step S35, the loudspeaker simulation filters 131-1 and 131-2 each add a loudspeaker characteristic specified by the filter to the audio signal of its frequency band, and supply the resultant signals to the amplifying units 114-1 and 114-2, respectively.

Then, at steps S36 and S37, the signals are amplified and then outputted from the loudspeakers 115-1 and 115-2.

With the processed described above, operations and effects similar to those of the output unit 101 of FIG. 1 can be made possible, and various loudspeaker characteristics can be added. Thus, for example, by applying characteristics of an excellent loudspeaker to the loudspeaker simulation filters 131-1 and 131-2, an audio output just like the one from the excellent loudspeaker can be reproduced. As a result, audio quality of the audio output can be enhanced.

4. Third Modification Example

[Example of Structure of an Output Unit Subjecting an Audio Signal Including an Entire Band to a Loudspeaker Simulation Filter]

While the example has been described in which loudspeaker simulation filters adding the loudspeaker characteristic are provided to stages subsequent to the band division filters, the loudspeaker simulation filter may be provided to a stage previous to the band division filters and a filter process may be performed on the audio signal of the entire band.

Figure 16:
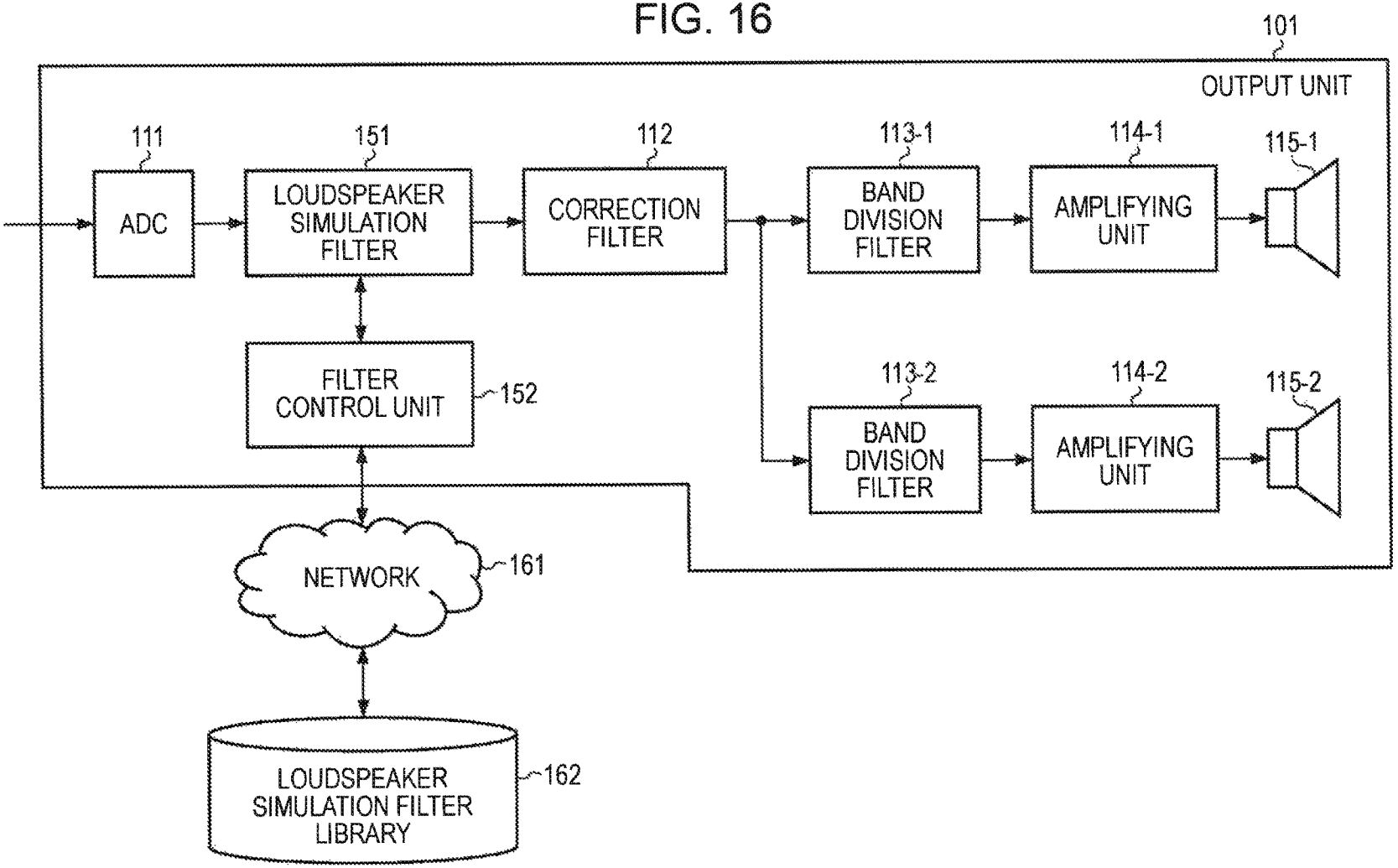
FIG. 16 is a diagram of an example of structure of an output unit to which the audio processing device according to a third modification example of the present technology is applied.

FIG. 16 depicts the output unit 101 in which loudspeaker simulation filters are provided to stages previous to the band division filters. In the output unit 101 of FIG. 16, a structure including the same function as that of the output unit 101 of FIG. 5 is provided with the same name and the same reference numeral, and description of that structure is omitted as appropriate. That is, the output unit 101 of FIG. 16 is different from the output unit 101 of FIG. 5 in that a loudspeaker simulation filter 151 is added between the ADC 111 and the correction filter 112. Furthermore, the loudspeaker characteristics to be added by the loudspeaker simulation filter 151 are set by a filter control unit 152. The filter control unit 152 downloads acoustic characteristics of various loudspeakers accumulated in a loudspeaker simulation filter library 162 communicable via a network 161, and sets the acoustic characteristics to the loudspeaker simulation filter 151. Therefore, the acoustic characteristics to be added by the loudspeaker simulation filter 151 can be variously switched and added.

[Output Process by the Output Unit of FIG. 16]

Figure 17:
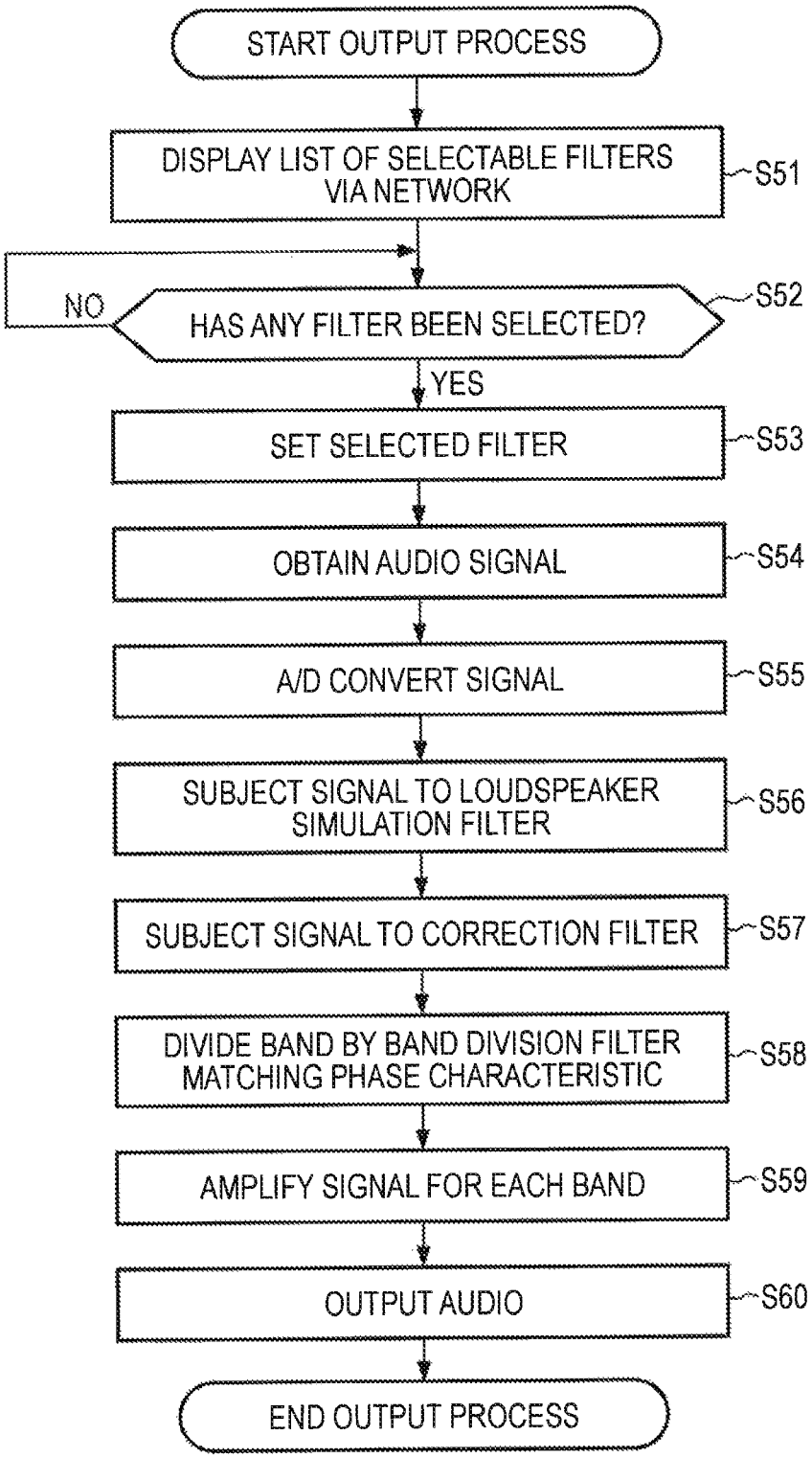
FIG. 17 is a flowchart for describing an output process by the output unit of FIG. 16.

Next, an output process by the output unit 101 of FIG. 16 is described with reference to a flowchart of FIG. 17. Note that processes at steps S54, S55, and S57 to S60 in the flowchart of FIG. 17 are similar to the processes at steps S1 to S6 described with reference to the flowchart of FIG. 10, and therefore are not described herein.

At step S51, the filter control unit 152 causes a list of available loudspeaker simulation filters accumulated in the loudspeaker simulation filter library 162 and downloaded via the network 161 to be displayed on a display unit including a display not shown. Also, an image prompting a user to select any of the loudspeaker simulation filters is displayed.

At step S52, the filter control unit 152 determines whether any of the loudspeaker simulation filters has been selected with an operating unit not shown being operated by the user. A process similar to the process described above is repeated until any loudspeaker simulation filter is selected. For example, if it is regarded that any of the loudspeaker simulation filters has been selected at step S52, the procedure goes to step S53.

At step S53, the filter control unit 152 downloads data of the selected loudspeaker simulation filter from among data of the loudspeaker simulation filters accumulated in the loudspeaker simulation filter library 162 via the network 161. The filter control unit 152 then sets the downloaded data of the loudspeaker simulation filter to the loudspeaker simulation filter 151.

Then, with processes at steps S54 and S55, an audio signal is obtained and is converted from analog to digital. At step S56, the loudspeaker simulation filter 151 performs a filter process set in the loudspeaker simulation filter 151 set by the filter control unit 152, thereby adding an acoustic characteristic to the audio signal.

With processes at steps S57 to S60, the audio signal is subjected to a correction filter, band division, and amplification for each band, and is then outputted as audio from the loudspeakers 115-1 and 115-2.

With the processes described above, operations and effects similar to those of the output unit 101 of FIG. 1 can be made possible, and various loudspeaker characteristics can be added as being switched thereamong. Thus, for example, by switching and applying characteristics of an excellent loudspeaker to the loudspeaker simulation filter 151, an audio output just like the one obtained by switching the excellent loudspeaker can be reproduced. As a result, audio quality of the audio output can be enhanced.

5. FOURTH MODIFICATION EXAMPLE

[Example of Structure in which the Output Unit is Applied to an Earphone]

While the example has been described above in which the output unit 101 is configured as loudspeakers, earphones using balanced armature loudspeakers have been present in recent years, and therefore the structure of the output unit 101 described above may be applied to an earphone. Furthermore, with virtual reproduction by the earphone, the effect of auditory lateralization may further be enhanced.

Figure 18:
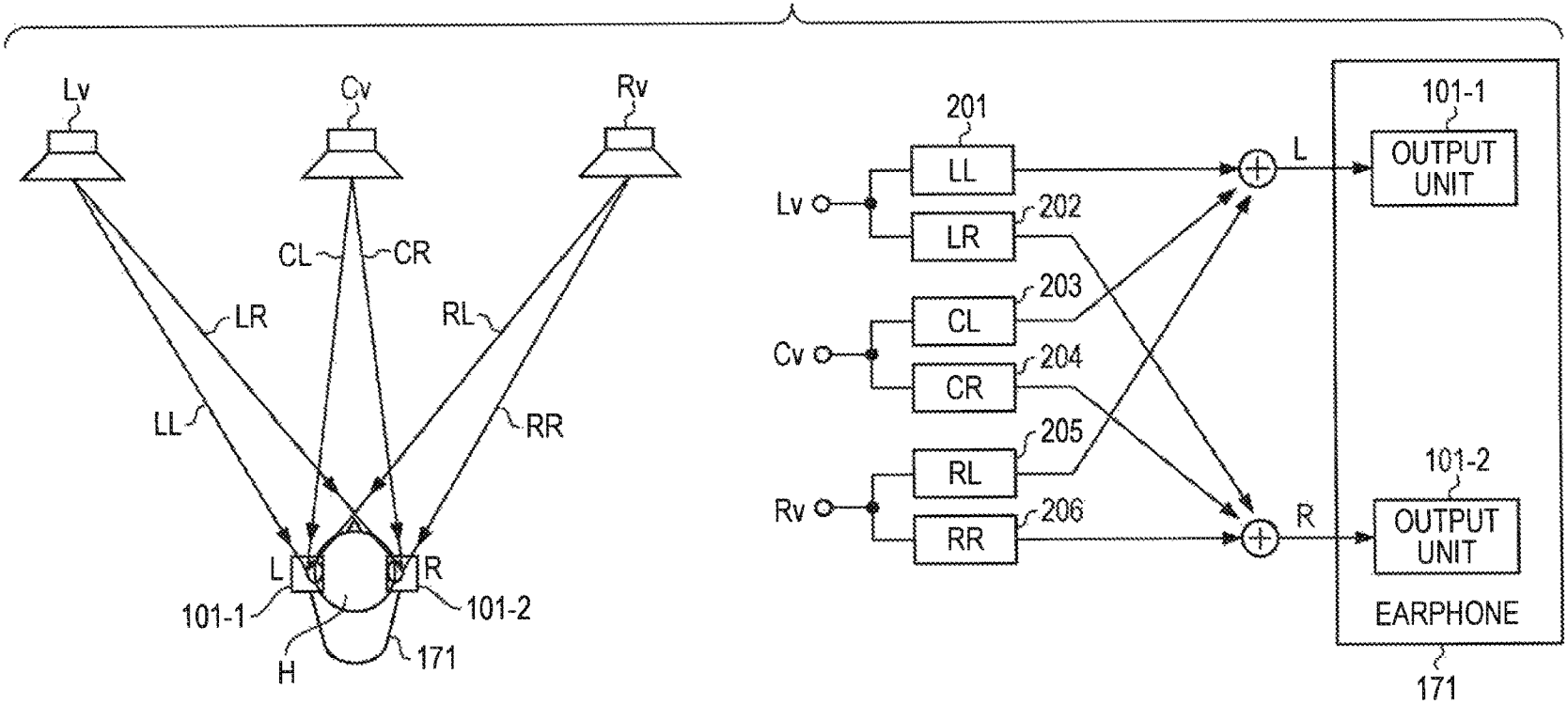
FIG. 18 is a diagram of an example of structure of an output unit to which the audio processing device according to a fourth modification example of the present technology is applied.

FIG. 18 depicts an example of structure for describing an example of virtual reproduction using an HRTF (a head related transfer function) by applying the output unit 101 to an earphone 171.

In the earphone 171, as depicted in left and right parts of FIG. 18, portions for use in left and right ears are configured to include output units 101-1 and 101-2, respectively. An audio output reproduced from the earphone 171 creates a state in which, loudspeakers Lv, Cv, and Rv at the front leftward, the front forward, and front rightward, respectively, viewed from a user H wearing the earphone 171 virtually output audio, as depicted in the left part of FIG. 18. Furthermore, with the loudspeakers Lv, Cv, and Rv outputting audio to the user H as if out-of-head sound localization (auditory lateralization) not shown other than that of the user H virtually exists, so-called virtual reproduction is implemented.

In more detail, as depicted in the right part of FIG. 18, the earphone 171 is configured to include the output units 101-1 and 101-2. In the right part of FIG. 18, the output unit 101-1 of the earphone 171 outputs audio of a left channel L, and the output unit 101-2 thereof outputs audio of a right channel R. Also, among audio signals Lv, Cv, and Rv with the loudspeakers Lv, Cv, and Rv as sound sources, audio signals reaching the left ear of the user H as the left channel L are represented as audio signals Lv×LL, Cv×CL, and Rv×RL, where head-related transfer functions are represented as LL, CL, and RL depicted in the right part of FIG. 18 corresponding to routes LL, CL, and RL depicted in the left part of FIG. 18. Similarly, among audio signals Lv, Cv, and Rv with the loudspeakers Lv, Cv, and Rv as sound sources, audio signals reaching the right ear of the user H as the right channel R are represented as audio signals Lv×LR, Cv×CR, and Rv×RR, where head-related transfer functions are represented as LR, CR, and RR depicted in the right part of FIG. 18 corresponding to routes LR, CR, and RR depicted in the left part of FIG. 18.

Note that head-related transfer function processing units HRTFs 201 and 202 depicted in the right part of FIG. 18 perform arithmetic computing processes defined by the head-related transfer functions LL and LR on the audio signal Lv, and then supply the resultant signal to the output units 101-1 and 101-2, respectively. Also, head-related transfer function processing units HRTFs 203 and 204 perform arithmetic computing processes defined by the head-related transfer functions CL and CR on the audio signal Cv, and then supply the resultant signal to the output units 101-1 and 101-2, respectively. Furthermore, head-related transfer function processing units HRTFs 205 and 206 perform arithmetic computing processes defined by the head-related transfer functions RL and RR on the audio signal Rv, and then supply the resultant signal to the output units 101-1 and 101-2, respectively.

An adder 211-1 adds the audio signals Lv×LL, Cv×CL, and Rv×RL together for synthesis, and supplies the resultant signal to the output unit 101-1 outputting an audio signal of the left channel L. Similarly, an adder 211-2 adds the audio signals Lv×LR, Cv×CR, and Rv×RR together for synthesis, and supplies the resultant signal to the output unit 101-2 outputting an audio signal of the right channel R.

The output units 101-1 and 101-2 perform an output process including band division to enhance audio quality of the audio signals with the loudspeakers Lv, CV, and Rv as sound sources, and output audio to the left and right ears. As a result, the user H can listen to the audio with enhanced audio quality while recognizing auditory lateralization as out-of-head sound localization, based on the audio output of the loudspeakers Lv, Cv, and Rv that are virtually configured, and therefore virtual reproduction is performed.

Virtual Reproducing Process

Figure 19:
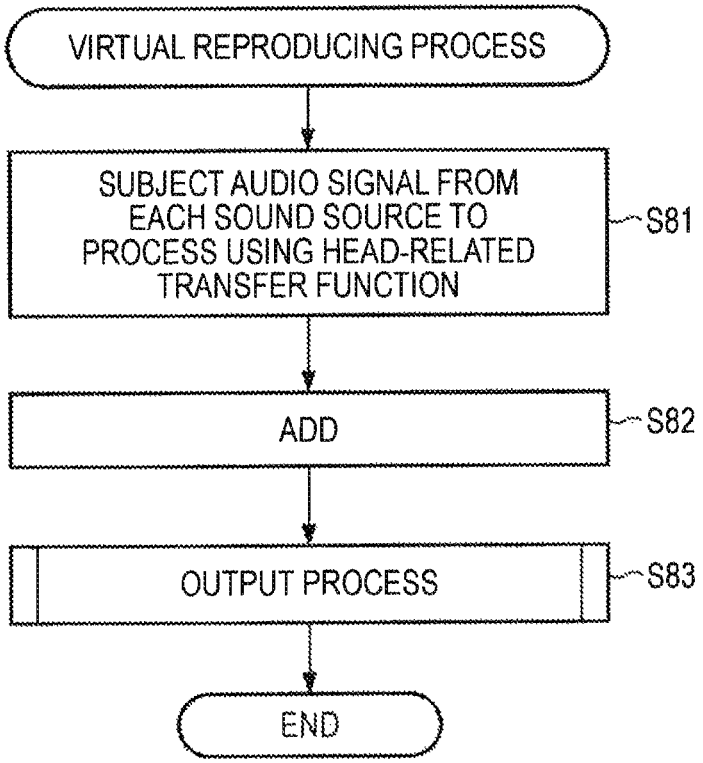
FIG. 19 is a flowchart for describing a virtual reproducing process by the output unit of FIG. 18.

Next, a virtual reproducing process with the earphone 171 of FIG. 18 is described with reference to a flowchart of FIG. 19.

At step S81, the head-related transfer function processing units HRTFs 201 to 206 perform arithmetic computing processes defined by the head-related transfer functions LL, LR, CL, CR, RL, and RR on the audio signals Lv, Cv, and Rv, and output the results to the adders 211-1 and 211-2.

At step S82, the adder 211-1 adds the supplied audio signals Lv×LL, Cv×CL, and Rv×RL together, and outputs the result to the output unit 101-1. Also, the adder 211-2 adds the supplied audio signals Lv×LR, Cv×CR, and Rv×RR together, and outputs the result to the output unit 101-2.

At step S83, the output units 101-1 and 101-2 performs output processes based on the respective supplied audio signals, enhance audio quality of the audio signals, and output audio. Note that each of these output processes is similar to the process described with reference to the flowchart of FIG. 10, and therefore is not described herein.

With the processes described above, the phase difference based on the frequency-phase characteristics is set at approximately 0 degree or approximately 180 degrees, thereby improving the frequency-amplitude characteristics and the frequency-phase characteristics as a whole. Therefore, virtual reproduction with wideband audio excellent in tone balance and having enhanced audio quality can be made.

Also, when music digitalization is performed on a CD (compact disk), its sampling rate is 44.1 kHz. In the case of contents for DVDs (digital versatile disks) and Blu-ray disks in recent years, the sampling rate is typically 48 kHz. However, the contents with a higher sampling rate of 96 kHz or 192 kHz are also present. When the sampling rate increases, the filter length of FIR increases to obtain a low-band correction effect. When the sampling rate is simply increased from 48 kHz to 96 kHz, a two-fold filter length is used to obtain an approximately equivalent effect, For wideband reproduction with 192 kHz or higher, many more loudspeaker units are used, and a 3-way or more loudspeaker system may possibly come along. In view of these circumstances, with an increased sampling rate and an increased number of loudspeaker units, if the signal is subjected to the band division filters and then to filter correction for each divided band as in related art, the amount of arithmetic computation is enormous. Thus, as described above, by configuring band division filters so that the phase difference of the frequency-phase characteristics is approximately 0 degree or approximately 180 degrees and providing only one correction filter to a stage previous to the band division filters, the number of arithmetic computation resources can be reduced.

Furthermore, it can be thought that wideband reproduction environment can be made possible in the future by combining different loudspeaker units even in a loudspeaker-equipped mobile device (such as an MP3 (MPEG Audio Layer-3) player, a portable phone, a notebook PC (personal computer), or a tablet PC). Also in that case, audio with enhanced audio quality can be outputted.

The series of processes described above can be performed by hardware or software. When the series of processes is performed by software, a program configuring that software is installed in a computer. Here, the computer includes a computer incorporated in dedicated hardware and, for example, a general-purpose personal computer capable of performing various functions by having various program installed therein.

Figure 20:
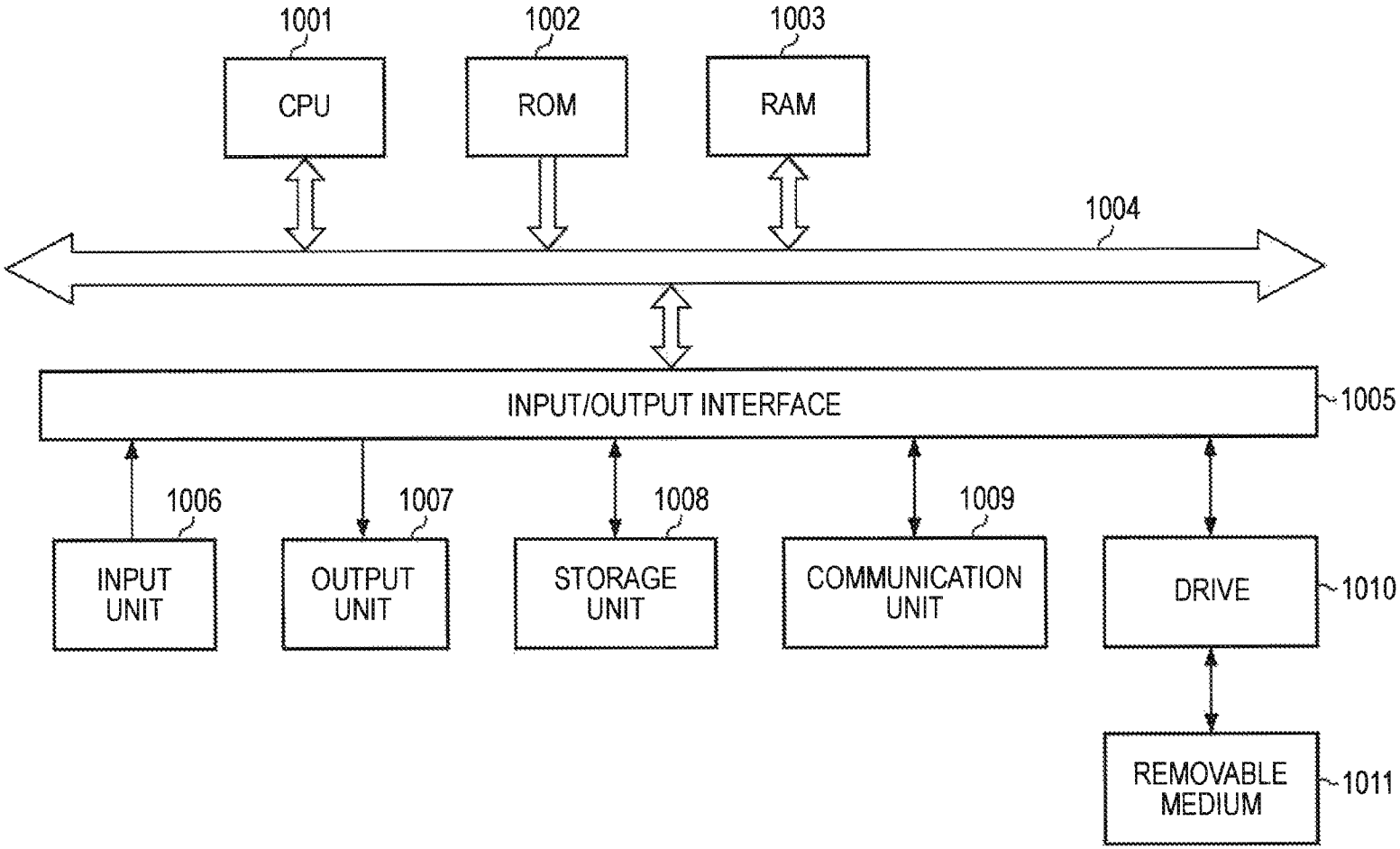
FIG. 20 is a diagram for describing an example of structure of a general-purpose personal computer.

FIG. 20 is a block diagram of an example of structure of hardware of a computer performing the series of processes described above with a program.

In the computer, a CPU (central processing unit) 1001, a ROM (read only memory) 1002, and a RAM (random access memory) 1003 are connected to each other via a bus 1004.

To the bus 1004, an input/output interface 1005 is further connected. To the input/output interface 1005, an input unit 1006, an output unit 1007, a storage unit 1008, a communication unit 1009, and a drive 1010 are connected.

The input unit 1006 is formed of a keyboard, a mouse, a microphone, and others. The output unit 1007 is formed of a display, a loudspeaker, and others. The storage unit 1008 is formed of a hard disk, a non-volatile memory, and others. The communication unit 1009 is formed of a network interface and others. The drive 1010 drives a removable medium 1011 such as a magnetic disk, an optical disk, a magneto-optical disk, or a semiconductor memory.

In the computer configured as above, the series of processes described above is performed by the CPU 1001 loading, for example, a program stored in the storage unit 1008 via the input/output interface 1005 and the bus 1004 into the RAM 1003 for execution.

The program to be executed by the computer (the CPU 1001) can be provided, for example, as being recorded on the removable medium 1011 as a package medium or the like. Also, the program can be provided via a wired or wireless transmission medium, such as a local area network, the Internet, or digital satellite broadcasting.

In the computer, the program can be installed in the storage unit 1008 via the input/output interface 1005, with the removable medium 1011 being inserted in the drive 1010. Also, the program can be received at the communication unit 1009 via a wired or wireless transmission medium and can be installed in the storage unit 1008. In addition, the program can be installed in advance in the ROM 1002 or the storage unit 1008.

Note that the program to be executed by the computer may be a program causing processes to be performed in time series according to the order described in the specification, a program causing processes to be performed in parallel, or a program causing processes to be performed at a timing, such as when a call is issued.

Also, the system in the specification refers to a set of a plurality of components (such as devices, modules (parts), or others), irrespectively of all components being contained in a same box. Therefore, a plurality of devices accommodated in separate boxes and connected to each other via a network and one device having a plurality of modules accommodated in one box are both systems.

Embodiments of the present technology are not meant to be restricted to the embodiments described above, and can be variously modified within a scope not deviating the gist of the present technology.

For example, an embodiment of the present technology can take a structure of cloud computing in which one function is shared among and processed in collaboration with a plurality of devices via a network.

Each step described in the flowcharts above can be executed by one device or a plurality of devices in a shared manner.

Furthermore, when one step includes a plurality of processes, the plurality of processes included in that one step can be performed by one device or a plurality of devices in a shared manner.

Note that an embodiment of the present technology can take the structures as follows.

(1) An audio processing device including:

a plurality of loudspeakers outputting audio for each band;

a correction filter correcting an audio signal including a plurality of bands in accordance with characteristics of the plurality of loudspeakers; and a plurality of band division filters dividing the audio signal corrected by the correction filter into bands of the loudspeakers so that a phase difference of phase characteristics is approximately 0 degree or approximately 180 degrees; wherein the correction filter is an inverse filter set with an impulse response based on the audio outputted for each band from the plurality of loudspeakers via the plurality of band division filters.

(2) The audio processing device according to (1), wherein the plurality of band division filters divide the audio signal corrected by the correction filter only for a predetermined frequency band into the bands of the loudspeakers so that the phase difference of the phase characteristics is approximately 0 degree or approximately 180 degrees.

(3) The audio processing device according to (1) or (2), further including:

an amplifying unit amplifying the audio signal; wherein the amplifying unit is formed of one amplifying unit amplifying the audio signal before division by the band division filters or a plurality of amplifying units amplifying the audio signal for each band obtained from division by the band division filters.

(4) The audio processing device according to any one of (1) to (3) further including:

an additional filter adding an acoustic characteristic of another audio processing device to the audio signal; wherein the acoustic characteristic of the other audio processing device is downloaded from a library connected via a network.

(5) The audio processing device according to (4), wherein the additional, filter is formed of one additional filter adding the audio characteristic of the other audio processing device to the audio signal before division by the band division filters or a plurality of additional filters adding the audio characteristic of the other audio processing device for each band obtained from division by the band division filters.

(6) An earphone including the audio processing device of any one of (1) to (5), wherein the audio signal to be inputted is a multichannel audio signal synthesized with an audio signal subjected to auditory lateralization with a head-related transfer function.

(7) An audio processing method for an audio processing device including a plurality of loudspeakers outputting audio for each band, the method including:

performing a process, with a correction filter, of correcting an audio signal including a plurality of bands in accordance with characteristics of the loudspeakers; and performing a process, with a plurality of band division filters, of dividing the audio signal corrected by the correction filter into bands of the loudspeakers so that a phase difference of phase characteristics is approximately 0 degree or approximately 180 degrees; wherein the correction filter is an inverse filter set with an impulse response based on the audio outputted for each hand from the plurality of loudspeakers via the plurality of band division filters.

(8) A program causing a computer controlling an audio processing device including a plurality of loudspeakers for outputting audio for each band to function as:

a correction filter correcting an audio signal including a plurality of bands in accordance with characteristics of the plurality of loudspeakers; and a plurality of band division filters dividing the audio signal corrected by the correction filter into bands of the loudspeakers so that a phase difference of phase characteristics is approximately 0 degree or approximately 180 degrees; wherein the correction filter is an inverse filter set with an impulse response based on the audio outputted for each band from the plurality of loudspeakers via the plurality of band division filters.

(9) A recording medium having the program according to (8) recorded thereon.

The present disclosure contains subject matter related to that disclosed in Japanese Priority Patent Application JP 2011-223415 filed in the Japan Patent Office on Oct. 7, 2011, the entire contents of which are hereby incorporated by reference.

What is claimed is:

1. An audio processing device comprising:

a plurality of loudspeakers each outputting audio for a respective band of a plurality of bands of an audio signal; and a correction filter configured to, prior to division of the audio signal, correct the audio signal in accordance with characteristics of a respective one of the plurality of loudspeakers via a plurality of band division filters, wherein phase waveforms representing frequency-phase characteristics of respective band division filters of the plurality of band division filters exactly match so that a phase difference of the frequency-phase characteristics between respective band division filters of the plurality of band division filters is approximately 0 degrees or approximately 180 degrees, wherein the plurality of band division filters divide the corrected audio signal into the bands of the plurality of loudspeakers so that a phase difference between audio signals outputted via respective bands of the plurality of bands is approximately 0 degrees or approximately 180 degrees, and wherein the correction filter is an inverse filter set with an impulse response based on a measurement by picking up, with use of a microphone, the audio outputted for each band from the plurality of loudspeakers via the plurality of band division filters.

2. The audio processing device according to claim 1, wherein the plurality of band division filters divide the corrected audio signal only for a predetermined frequency band into the bands of the plurality of loudspeakers so that the phase difference between the audio signals is approximately 0 degrees or approximately 180 degrees.

3. The audio processing device according to claim 1, further comprising:

an amplifying unit amplifying the audio signal, wherein the amplifying unit is formed of one amplifying unit amplifying the audio signal before division by the plurality of band division filters or a plurality of amplifying units amplifying the audio signal for each band obtained from division by the plurality of band division filters.

4. The audio processing device according to claim 1, further comprising:

an additional filter adding an acoustic characteristic of another audio processing device to the audio signal, wherein the acoustic characteristic of the another audio processing device is downloaded from a library connected via a network.

5. The audio processing device according to claim 4, wherein the additional filter is formed of one additional filter adding the acoustic characteristic of the another audio processing device to the audio signal before division by the plurality of band division filters or a plurality of additional filters adding the acoustic characteristic of the another audio processing device for each band obtained from division by the plurality of band division filters.

6. An earphone comprising:

the audio processing device of claim 1, wherein the audio signal to be inputted is a multichannel audio signal synthesized with an audio signal subjected to auditory lateralization with a head-related transfer function.

7. The audio processing device according to claim 1, wherein the impulse response of the inverse filter is set based on a measured impulse response that is obtained from audio signals outputted from the plurality of loudspeakers without having been subjected to the correction by the correction filter.

8. The audio processing device according to claim 1, wherein the measurement is measured by picking the audio signal outputted from the plurality of loudspeakers via the plurality of band division filters without the correction by the correction filter.

9. The audio processing device according to claim 1, wherein the plurality of band division filters divide the audio signal corrected by the correction filter into the bands of the plurality of loudspeakers so that the phase difference of the frequency-phase characteristics between respective band division filters of the plurality of band division filters is approximately 0 degrees.

10. The audio processing device according to claim 1, wherein the plurality of band division filters divide the audio signal corrected by the correction filter into the bands of the plurality of loudspeakers so that the phase difference of the frequency-phase characteristics between respective band division filters of the plurality of band division filters is approximately 180 degrees.

11. The audio processing device according to claim 1, wherein the plurality of band division filters each divide the corrected audio signal by a respective frequency band corresponding to a respective one of the plurality of loudspeakers so that phases of divided frequency bands match each other and the frequency-phase characteristics of each one of the plurality of band division filters are set such that frequency-amplitude characteristics of corresponding frequency bands are approximately flattened.

12. The audio processing device according to claim 1, wherein the plurality of band division filters each divide the corrected audio signal by a respective frequency band corresponding to the respective one of the plurality of loudspeakers so that phases of divided frequency bands match each other by being either in-phase or 180 degrees out-of-phase.

13. The audio processing device according to claim 1, wherein the plurality of band division filters is further configured to include target frequency characteristics which divide the audio signal into bands of loudspeaker having various characteristics.

14. The audio processing device according to claim 1, wherein the correction filter is further configured to, prior to division of the audio signal, simultaneously correct the audio signals outputted via the respective bands of the plurality of bands from respective speakers of the plurality of loudspeakers.

15. An audio processing method for an audio processing device including a plurality of loudspeakers each outputting audio for a respective band of a plurality of bands of an audio signal, the method comprising:

correcting, prior to division of the audio signal and with a correction filter, the audio signal in accordance with characteristics of a respective one of the plurality of loudspeakers via a plurality of band division filters, wherein phase waveforms representing frequency-phase characteristics of respective filters of the plurality of band division filters exactly match so that a phase difference of the frequency-phase characteristics between respective band division filters of the plurality of band division filters is approximately 0 degrees or approximately 180 degrees; and dividing, with the plurality of band division filters, the audio signal corrected by the correction filter into the bands of the plurality of loudspeakers so that a phase difference between audio signals outputted via respective bands of the plurality of bands is approximately 0 degrees or approximately 180 degrees, wherein the correction filter is an inverse filter set with an impulse response based on a measurement by picking up, with use of a microphone, the audio outputted for each band from the plurality of loudspeakers via the plurality of band division filters.

16. A non-transitory computer-readable recording medium having embodied thereon a program, which when executed by a computer controlling an audio processing device including a plurality of loudspeakers each outputting audio for a respective band of a plurality of bands of an audio signal, causes the computer to execute a method, the method comprising:

correcting, prior to division of the audio signal, the audio signal in accordance with characteristics of a respective one of the plurality of loudspeakers via a plurality of band division filters, wherein phase waveforms representing frequency-phase characteristics of respective filters of the plurality of band division filters exactly match so that a phase difference of the frequency-phase characteristics between respective band division filters of the plurality of band division filters is approximately 0 degrees or approximately 180 degrees; and dividing the corrected audio signal into the bands of the plurality of loudspeakers so that a phase difference between audio signals outputted via respective bands of the plurality of bands is approximately 0 degrees or approximately 180 degrees, wherein the audio signal is corrected by inverse filtering based on an impulse response that is based on a measurement by picking up, with use of a microphone, the audio outputted for each band from the plurality of loudspeakers via the plurality of band division filters.

* * * * *